US010504632B2

(12) United States Patent
Wolf et al.

(10) Patent No.: US 10,504,632 B2
(45) Date of Patent: Dec. 10, 2019

(54) CANISTER MOVEMENT ASSEMBLY FOR TRANSFER, ROTATION, AND/OR INSPECTION

(71) Applicant: TN AMERICAS LLC, Columbia, MD (US)

(72) Inventors: Uwe Wolf, Silver Spring, MD (US); Aleksandr Kofman, Rockville, MD (US); Anthony Payumo Villaflores, Laurel, MD (US)

(73) Assignee: TN AMERICAS LLC, Columbia, MD (US)

( * ) Notice: Subject to any disclaimer, the term of this patent is extended or adjusted under 35 U.S.C. 154(b) by 0 days.

(21) Appl. No.: 15/365,612

(22) Filed: Nov. 30, 2016

(65) Prior Publication Data

US 2017/0154696 A1 Jun. 1, 2017

Related U.S. Application Data

(60) Provisional application No. 62/260,809, filed on Nov. 30, 2015.

(51) Int. Cl.

| | |
|---|---|
| ***G21F 5/14*** | (2006.01) |
| ***G21C 19/32*** | (2006.01) |
| ***G21C 19/07*** | (2006.01) |

(52) U.S. Cl.

CPC ..... *G21F 5/14* (2013.01); *G21C 19/07* (2013.01); *G21C 19/32* (2013.01)

(58) Field of Classification Search

CPC ..... G21C 19/32; G21F 5/14

USPC ..... 414/146, 349, 350, 352, 395, 396, 414/416.04, 433, 477, 478, 522, 532–535

See application file for complete search history.

(56) References Cited

U.S. PATENT DOCUMENTS 1,730,480 A * 10/1929 Shirreff ..... B60P 1/365 414/500
2,821,315 A * 1/1958 Bucher ..... B60P 3/1058 414/477
2,827,188 A * 3/1958 Reeder ..... B60P 3/1033 414/478

(Continued)

FOREIGN PATENT DOCUMENTS

JP 58167309 A * 10/1983 ..... B65G 65/00
JP 2003232884 A 8/2003

(Continued)

OTHER PUBLICATIONS

Extended European Search Report dated Jun. 8, 2016, issued in corresponding European Application No. 15197148.8, filed Nov. 30, 2015, 8 pages.

(Continued)

*Primary Examiner* — James Keenan

(74) *Attorney, Agent, or Firm* — Christensen O'Connor Johnson Kindness, PLLC

(57) ABSTRACT

A movement system for moving a dry shielded canister includes a stabilization portion, and a canister support portion engaged with the stabilization portion, the canister support portion including a roller interface for supporting and moving a canister. A method of moving a dry shielded canister includes moving a roller interface from a retracted position to an extended position to engage with the canister; and moving the canister.

19 Claims, 27 Drawing Sheets

(56) References Cited

U.S. PATENT DOCUMENTS 2,904,196 A * 9/1959 Teixeira ..... B60P 1/52 193/35 R
3,243,062 A * 3/1966 Frassetto ..... B60P 1/52 193/35 MD
3,250,437 A * 5/1966 Smith ..... B60P 3/22 137/355.16
3,455,474 A * 7/1969 Truncali ..... B60P 1/52 414/485
4,062,456 A * 12/1977 Birdwell ..... B65G 1/0442 414/433
4,279,559 A * 7/1981 Stumpf ..... B23K 37/0538 193/35 B
4,390,040 A * 6/1983 Beyen ..... F17C 13/12 137/340
4,416,579 A * 11/1983 Alberti ..... B64C 1/20 410/94
4,780,269 A * 10/1988 Fischer ..... G21C 19/07 220/23.87
4,930,612 A * 6/1990 Thorndyke ..... B65G 13/12 193/35 SS
5,088,585 A * 2/1992 Lambert ..... B65G 13/12 193/35 SS
8,657,549 B2 * 2/2014 Grubb ..... G21C 19/07 376/272
9,564,250 B2 * 2/2017 Bresous ..... G21C 19/11
9,724,790 B2 * 8/2017 Grubb ..... B23P 6/00
2005/0008465 A1 * 1/2005 Szymanski ..... B60L 11/1822 414/522
2009/0304137 A1 12/2009 Bersegol et al.
2012/0183375 A1 * 7/2012 Bracey ..... G21F 5/065 414/146
2014/0186144 A1 7/2014 Singh
2014/0334903 A1 * 11/2014 Noe ..... F16M 11/2028 414/433
2017/0263343 A1 * 9/2017 He ..... G21F 5/14

FOREIGN PATENT DOCUMENTS

JP 2004069591 A 3/2004
JP 2005331359 A 2/2005
WO 2013/162656 A2 10/2013

OTHER PUBLICATIONS

International Search Report and Written Opinion dated Mar. 16, 2017, issued in corresponding International Application No. PCT/US2016/064258, filed Nov. 30, 2016, 14 pages.
International Preliminary Report on Patentability dated Jun. 14, 2018, issued in corresponding International Application No. PCT/US2016/064258, filed Nov. 30, 2016, 10 pages.

* cited by examiner

CANISTER MOVEMENT ASSEMBLY FOR TRANSFER, ROTATION, AND/OR INSPECTION

CROSS-REFERENCE TO RELATED APPLICATION

This application claims the benefit of U.S. Provisional Application No. 62/260,809, filed Nov. 30, 2015, the disclosure of which is hereby expressly incorporated by reference in its entirety.

BACKGROUND

Part of the operation of a nuclear power plant is the removal and disposal of irradiated nuclear fuel assemblies. Nuclear power plants often use a horizontal type of dry storage device for irradiated fuel called a dry shielded canister (DSC).

In a previously designed system, horizontal transfer of canisters containing irradiated fuel between transfer cask and horizontal storage module (HSM) is accomplished by precision alignment of metallic rails inside the transfer cask and metallic rails inside the HSM and sliding the canister on these rails. Likewise, periodic inspection and/or rotation of the canister require further transfer of the canister from the HSM by sliding the canister on the rails.

The precision alignment method requires a crew of personnel exposed to radiation during the time of the alignment process. Sliding the metallic surface of the canister on metallic rails may leave scratches on the surface of the canister, which is a potential cause for corrosion and breaching the confinement of the canister for long term storage.

Therefore, there exists a need for improved canister transfer systems. Embodiments of the present application address these and other needs.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a movement system for moving a dry shielded canister is provided. The system includes a stabilization portion, and a canister support portion engaged with the stabilization portion and configured for movement between an extended position and a retracted position, the canister support portion including a roller interface for supporting and moving a canister.

In accordance with another embodiment of the present disclosure, a method of moving a dry shielded canister is provided. The method includes moving the roller interface from a retracted position to an extended position to engage with the canister; and moving the canister.

In accordance with another embodiment of the present disclosure, a movement system for moving a dry shielded canister is provided. The system includes a stabilization portion; and a canister support portion engaged with the stabilization portion and configured for translational movement between an extended position and a retracted position, the canister support portion including a roller interface for supporting and moving a canister.

In accordance with another embodiment of the present disclosure, a method of moving a dry shielded canister is provided. The method includes moving a canister support portion engaged with a stabilization portion from a retracted position to an extended position; moving the roller interface from a retracted position to an extended position to engage with the canister; and moving the canister.

In any of the embodiments described herein, the canister support portion may be slidingly engaged with the stabilization portion.

In any of the embodiments described herein, the roller interface may include a plurality of roller rails.

In any of the embodiments described herein, the roller rails may include a plurality of rollers.

In any of the embodiments described herein, the roller rails may be configurable for orientation in extended and retracted positions.

In any of the embodiments described herein, the roller rails may be configurable for orientation in a stowed position.

In any of the embodiments described herein, the roller rails may be configurable for translational or rotational movement or both.

In any of the embodiments described herein, the system may further include a support vehicle to which the stabilization portion is coupled.

In any of the embodiments described herein, the system may further include canister inspection means adapted to inspect the canister as it moves on the roller rails.

In any of the embodiments described herein, the system may further include a canister inspection system.

In any of the embodiments described herein, the stabilization portion may be the horizontal storage module (HSM).

In any of the embodiments described herein, the canister support portion may be coupled to the horizontal storage module (HSM).

In any of the embodiments described herein, a method of moving a canister may further include moving the canister translationally or rotationally or both.

In any of the embodiments described herein, the canister may be moved rotationally while in a horizontal storage module.

In any of the embodiments described herein, a method of moving a canister may further include retracting the roller interface after moving the canister.

In any of the embodiments described herein, a method of moving a canister may further include moving a canister support portion engaged with a stabilization portion from a retracted position to an extended position.

In any of the embodiments described herein, a method of moving a canister may further include retracting the canister support portion after retracting the roller interface.

In any of the embodiments described herein, a method of moving a canister may further include inspecting the canister while moving the canister.

In any of the embodiments described herein, a method of moving a canister may include moving a roller interface from a retracted position to an extended position to engage with the canister using a cam system.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of the features described herein.

Embodiments of the present disclosure are directed to canister movement assemblies used for canister C transfer between a cask K and an HSM 10, as well as for periodic rotation and inspection of the canister C within an HSM 10.

Referring now to FIGS. 1-3D, a canister movement assembly 220 in accordance with one embodiment of the present disclosure will now be described. The canister movement assembly 220 may be used in conjunction with a staggered HSM 10 as described in the present application or in other types of HSMs or other storage modules, including but not limited to indoor storage, centralized interim storage (CIS), and stacked CIS storage. The canister movement assembly 220 may be used for transferring a dry shielded canister (DSC) or for different types of canisters.

Figure 1:
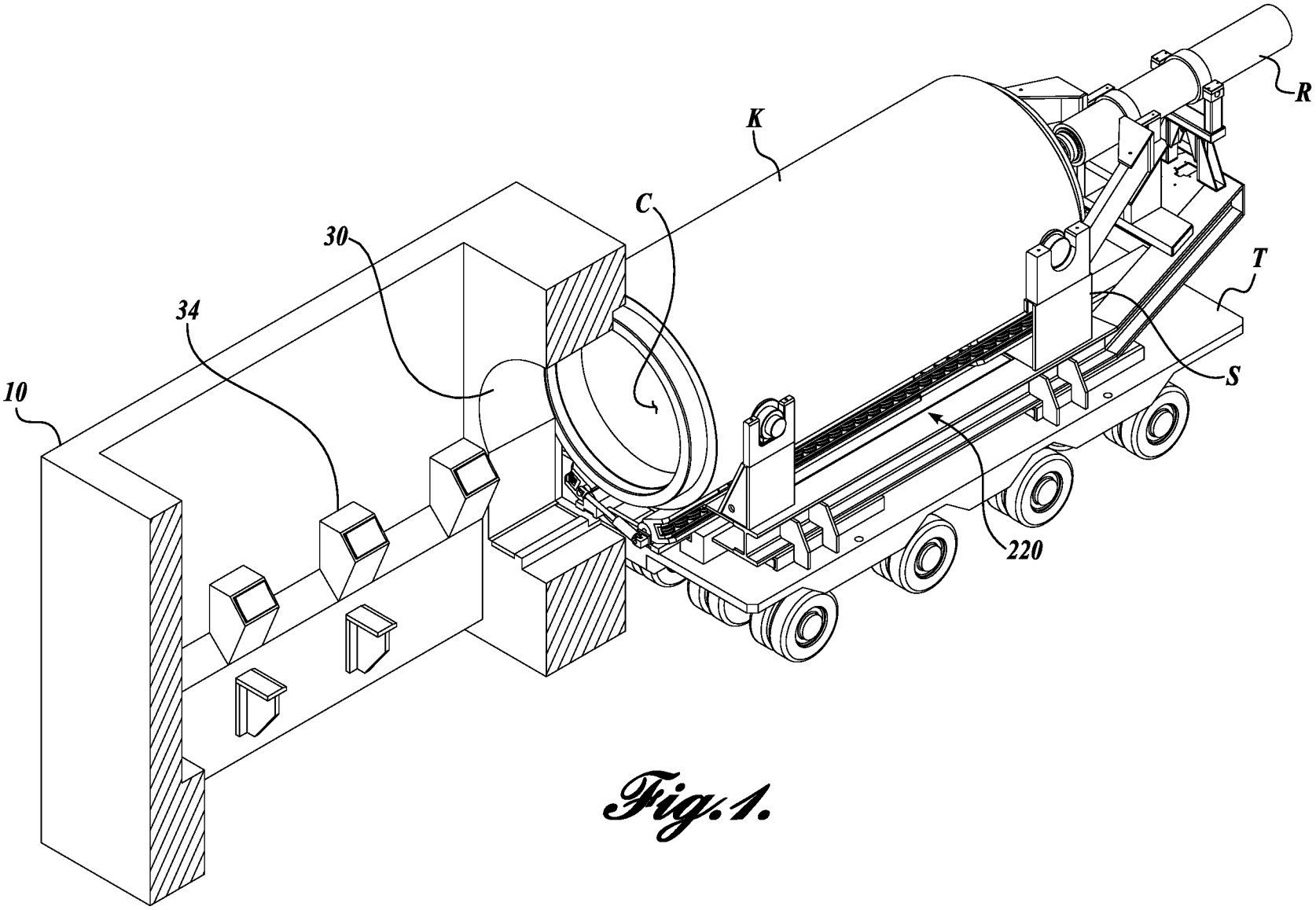
FIG. 1 is an isometric view of a movement system for a canister in accordance with one embodiment of the present disclosure.
Figure 2A:
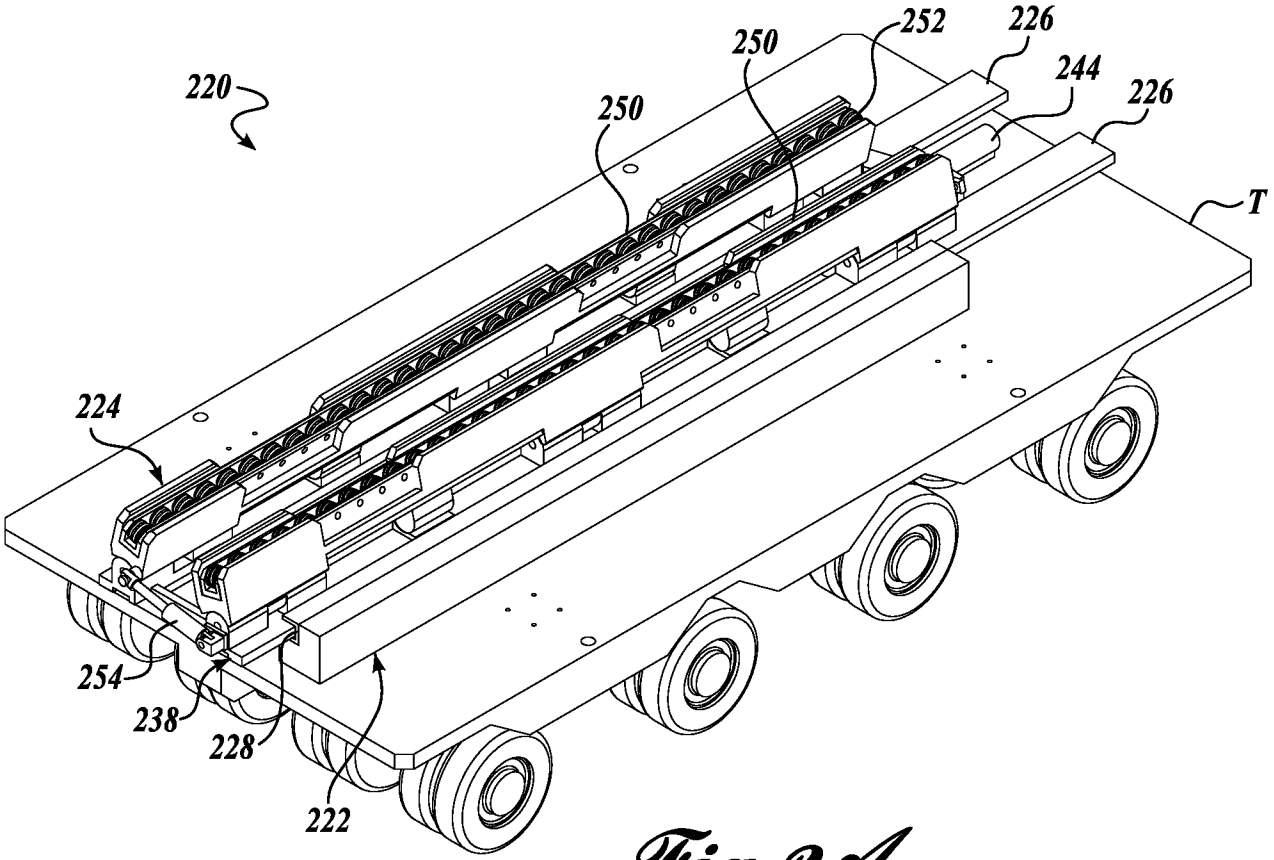
FIGS. 2A and 2B are isometric views of the movement system of FIG. 1 in respective retracted and extended position.
Figure 2B:
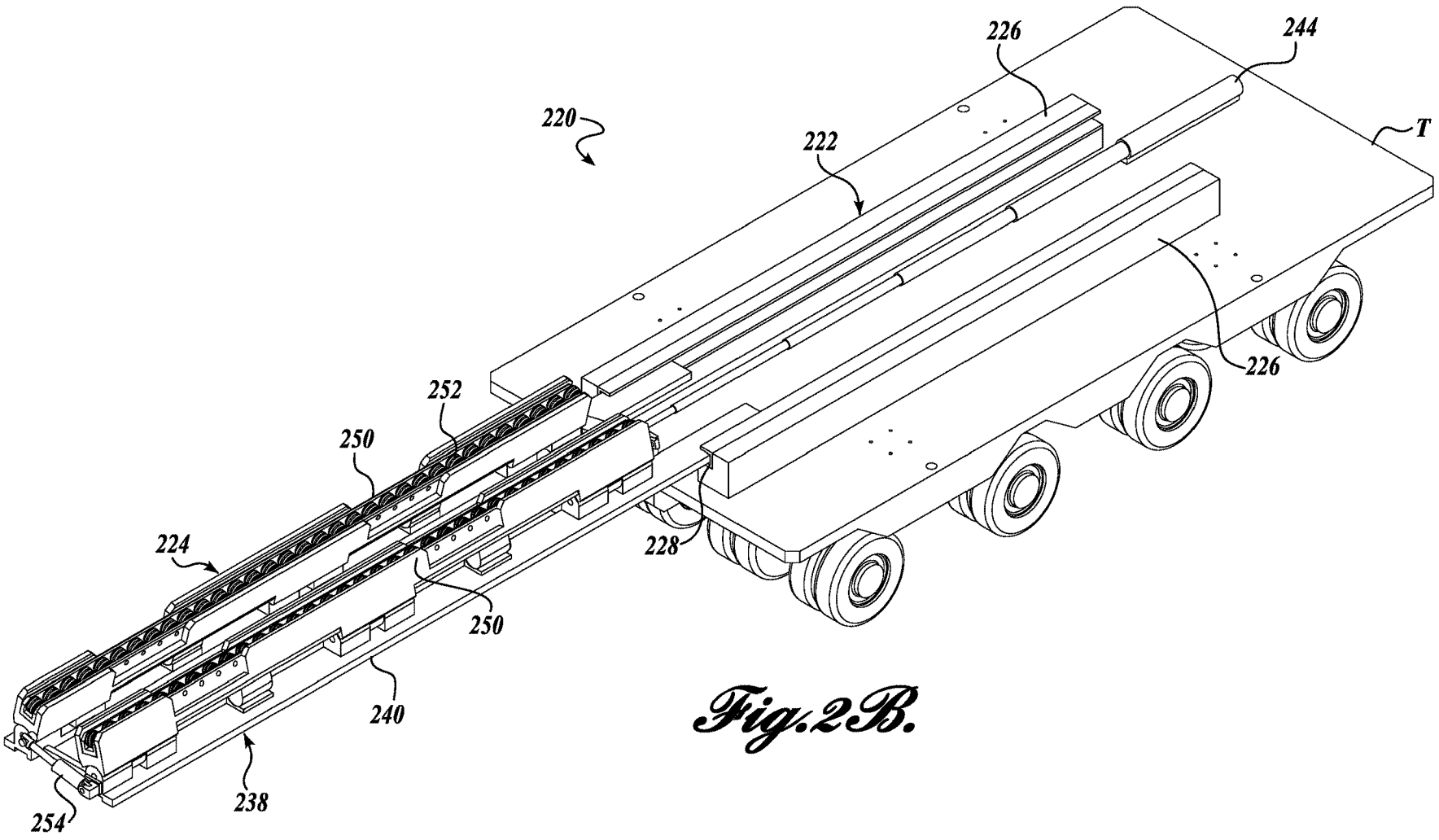

Referring to FIGS. 1 and 2, the canister movement assembly 220 is a retractable roller mechanism for lateral transfer and axial rotation of canisters C. In the illustrated embodiment, the canister movement assembly 220 is attached to a trailer T and includes a stabilization portion 222 and a canister support portion 224 capable of extending and retracting from the stabilization portion 222. The canister movement assembly 220 includes an actuator 244 for extending and retracting the canister support portion 224 from the stabilization portion 222. The canister support portion 224 moves translationally between retracted and extended positions (compare FIGS. 2A and 2B). In the illustrated embodiment, the actuator 244 is a telescoping actuator. However, other actuator systems are within the scope of the present disclosure.

Referring to FIGS. 1, 2A, and 2B, the canister movement assembly 220 is positioned on the trailer T under the skid S and the cask K. In this configuration, the canister movement assembly 220 is not in contact with the skid S or the cask K, but is deployable for use with the canister C, whether the canister C is contained within the cask K or within an adjacent compartment 30 in an HSM 10. In other embodiments, the canister movement assembly 220 may be attached to another transfer vehicle other than a trailer T.

The canister stabilization portion 222 includes two receiving rails 226 having elongate receiving channels 228 in an opposed configuration. The receiving rails are configured to slidably receive the canister support portion 224 as it moves translationally between retracted and extended positions (compare FIGS. 2A and 2B).

Figure 7A:
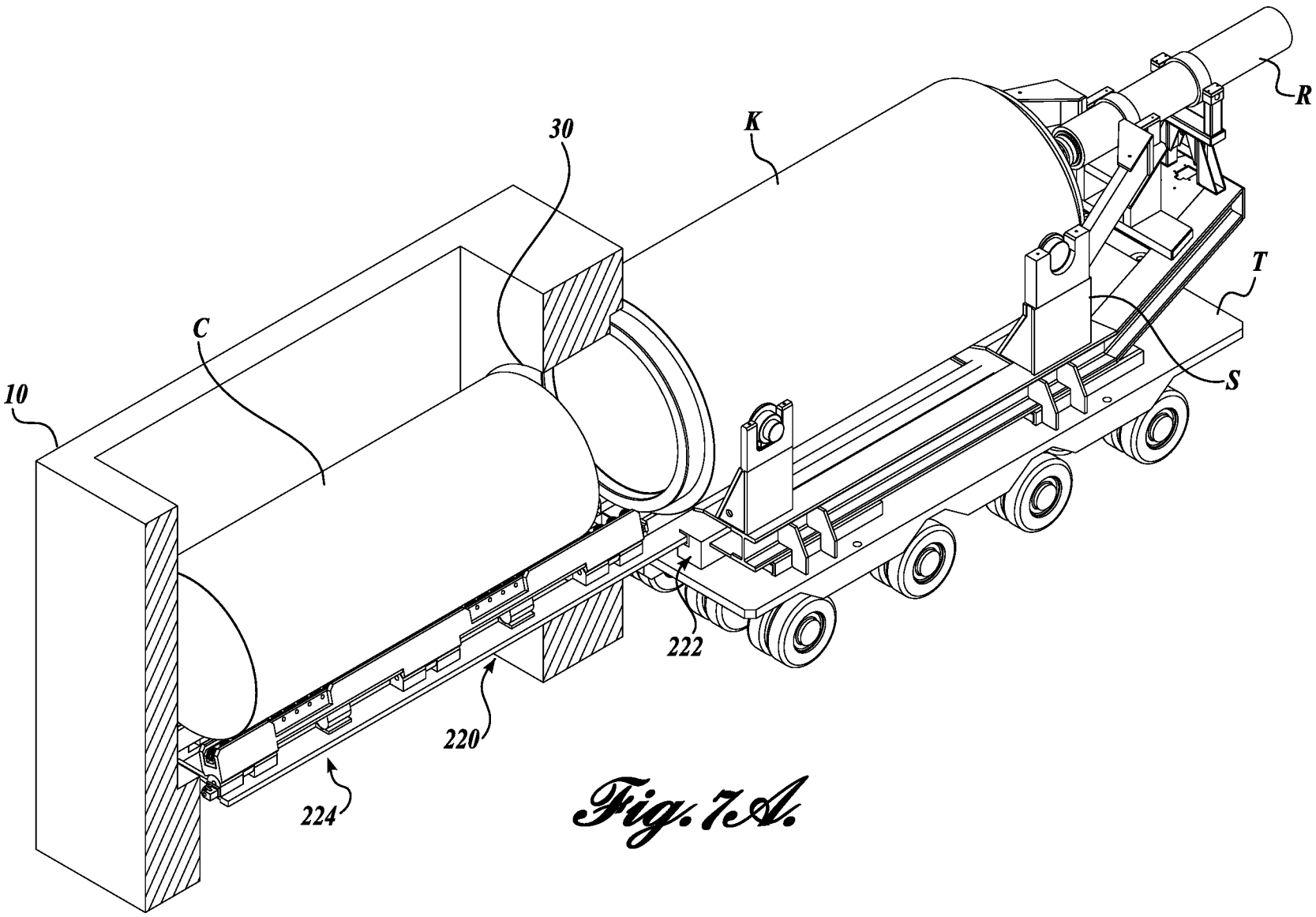

The receiving rails 226 of the canister stabilization portion 222 are suitable spaced from one another and suitably constructed to provide lateral and vertical support to the canister support portion 224 when it is fully loaded with a canister C and in the fully extended position (e.g., see FIG. 7A). In addition, the strength of the coupling between the receiving rails 226 and the trailer T may provide some lateral strength to the canister movement assembly 220 when it is in its extended position.

The canister support portion 224 is configured to extend and fit within the opening 30 of the HSM 10 and the pillow blocks 34 without making contact with the HSM 10. The canister support portion 224 includes a sliding portion 238. In the illustrated embodiment, the sliding portion include sliding plates 240 configured to interface with the canister stabilization portion 222 for sliding movement within the receiving channels 228. The sliding plates 240 are suitable spaced from one another and coupled by a plurality of coupling portions 242 (see FIGS. 3A and 4A).

In the illustrated embodiment, the canister support portion 224 includes two sliding plates 240 supported by three coupling portions 242. However, any number of coupling portions to provide adequate support to the sliding plates 240 is within the scope of the present disclosure. While coupling portions 242 reduce the overall weight of the canister support portion 224, the sliding portion 238 can be configured as a single plate.

The receiving channels 228 and/or the sliding plates 240 may be lined with a bearing material or may include another suitable bearing mechanism to support the sliding movement of the canister support portion 224 relative to the canister stabilization portion 222.

Although illustrated and described as being configured for sliding translational movement in receiving channels 228, other configurations for translational movement of the canister support portion 224 relative to the canister stabilization portion 222 are within the scope of the present disclosure.

The canister support portion 224 includes a roller interface for transferring the canister C. In the illustrated embodiment, the canister support portion 224 includes a plurality of roller rails 250 including a plurality of rollers 252. In the illustrated embodiment, the roller rails 250 are set up in two rows and are supported by the sliding portion 238, shown as sliding plates 240. The roller rails 250 are appropriately spaced from one another to provide stable support to a canister C having a circular cross-section. However, other groupings besides two and other spacings of roller rails 250 are within the scope of the present disclosure.

The rollers 252 on the roller rails 250 are designed to reduce friction as the canister C is moved translationally to or from the cask K or the HSM 10. The rollers 252 can also be used to rotate the canister C relative to its longitudinal axis for inspection or selective repositioning. For example, during inspection, the roller rails can be used to rotate the canister 360 degrees for full inspection. Inside the HSM 10, the roller rails can also be used to rotate the canister to a new stationary position. For example, the roller rails can be used to rotate the canister 180 degrees to a new stationary position.

The roller rails 250 are coupled to an actuation system 254 for moving the rails relative to the sliding portion 238 of the canister support portion 224. The actuation system 254 may include, for example, a pneumatic, hydraulic or electric rams.

Figure 3A:
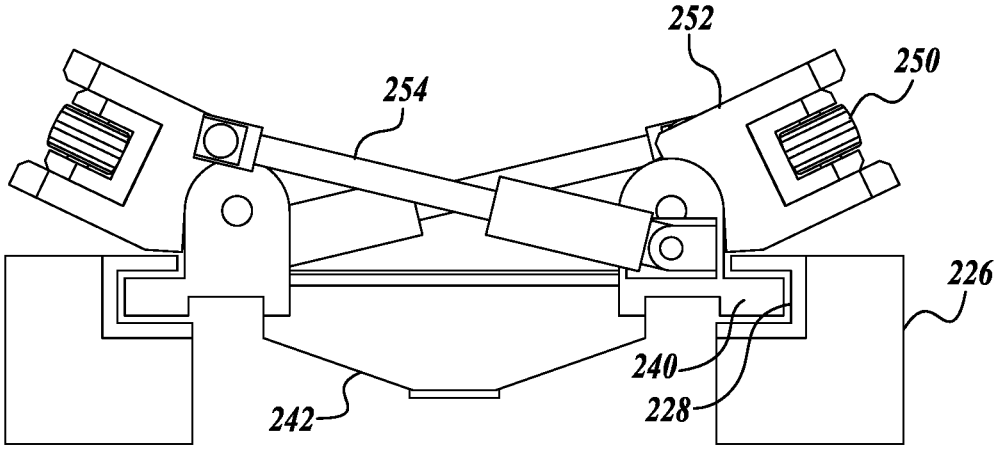
FIGS. 3A through 3D are cross-section views of roller rails in respective stowed, retracted, extended, and rotational orientations.
Figure 3B:
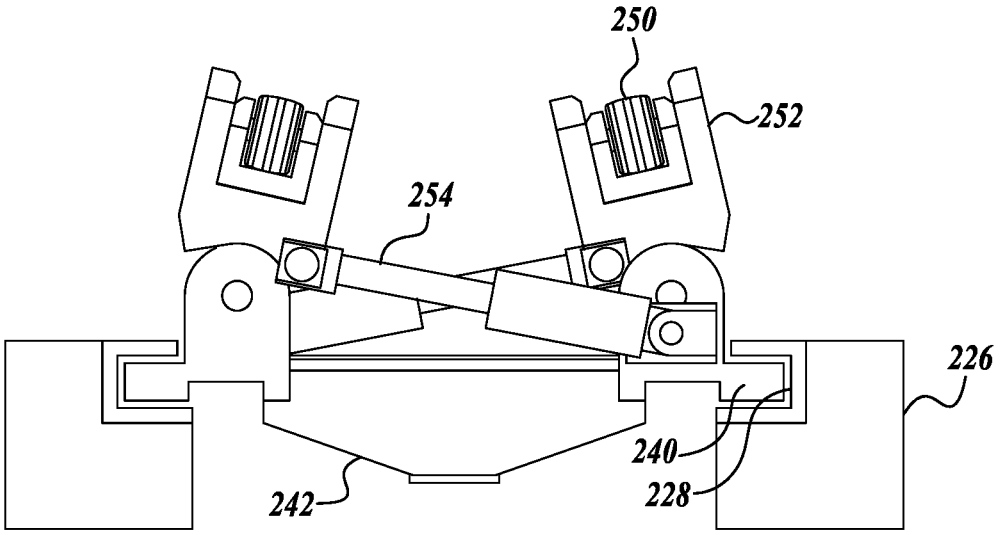
Figure 3C:
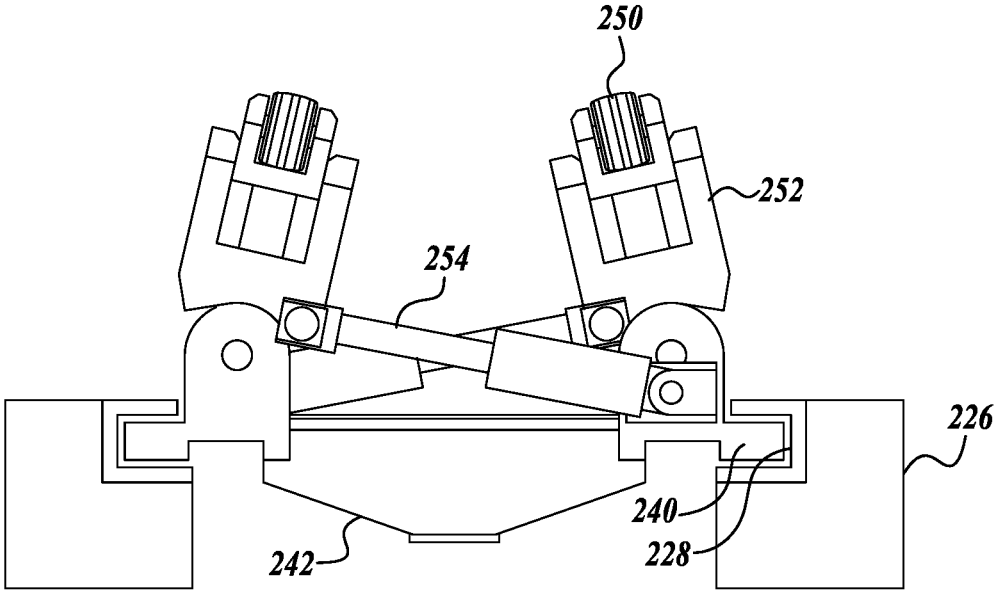
Figure 3D:
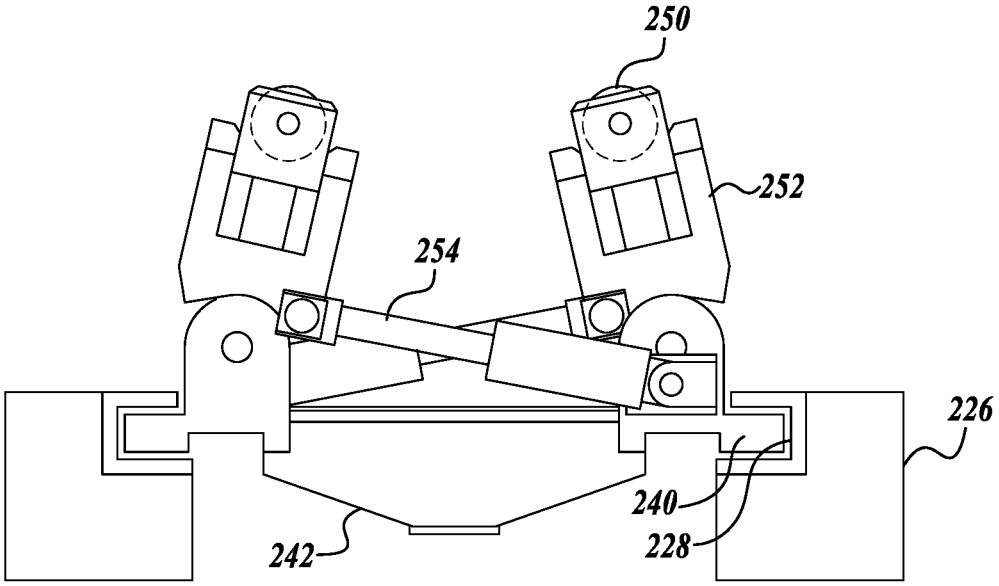

Referring to the cross-sectional views of the canister movement assembly 220 in various positions in FIGS. 3A-3D, the roller rails 250 are positionable in multiple orientations to support canister C translational and/or rotational movement. Referring to FIG. 3A, the roller rails are oriented in a first position away from each other in a stowed position. Referring to FIG. 3B, the roller rails 250 are oriented in a second position toward each other and retracted and are ready for positioning under a canister C. Referring to FIG. 3C, the roller rails 250 are oriented in a third position toward each other and lifted for contact with the canister C for translational movement. Referring to FIG. 3D, the roller rails 250 are oriented in a fourth position toward each other and lifted for contact with the canister C, but oriented for rotational movement of the canister C.

Referring to FIGS. 1 and 4A-8, methods of using the horizontal transfer system 220 in accordance with embodiments of the present disclosure will now be described. Referring to FIG. 1, the horizontal transfer system 220 is shown in a retracted position coupled to a transfer wagon T beneath the skid S and cask K and not in contact with the skid S or cask K.

Figure 4D:
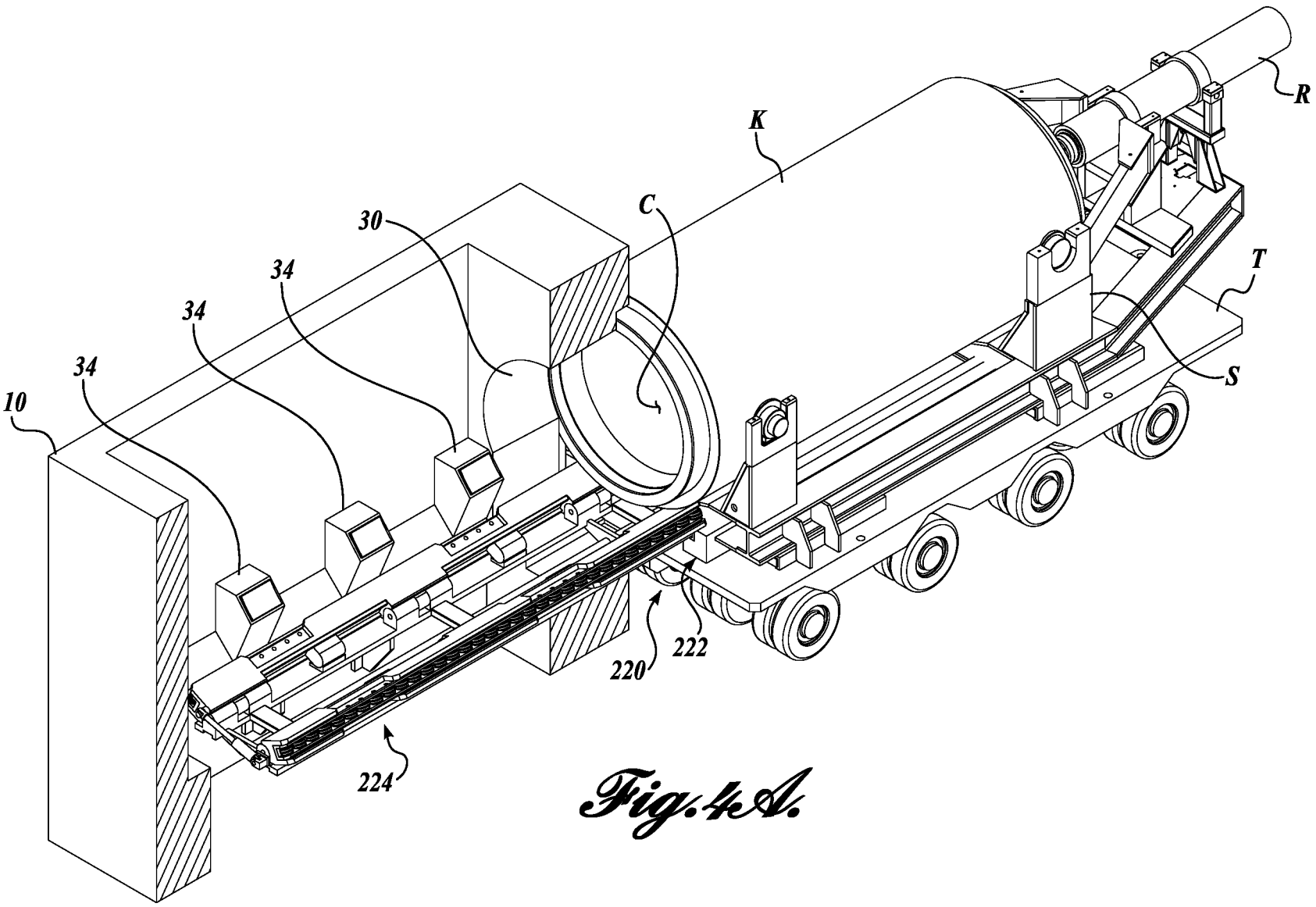
FIGS. 4A through 9 are various isometric views showing methods of using the movement system in accordance with embodiments of the present disclosure.
Figure 4B:
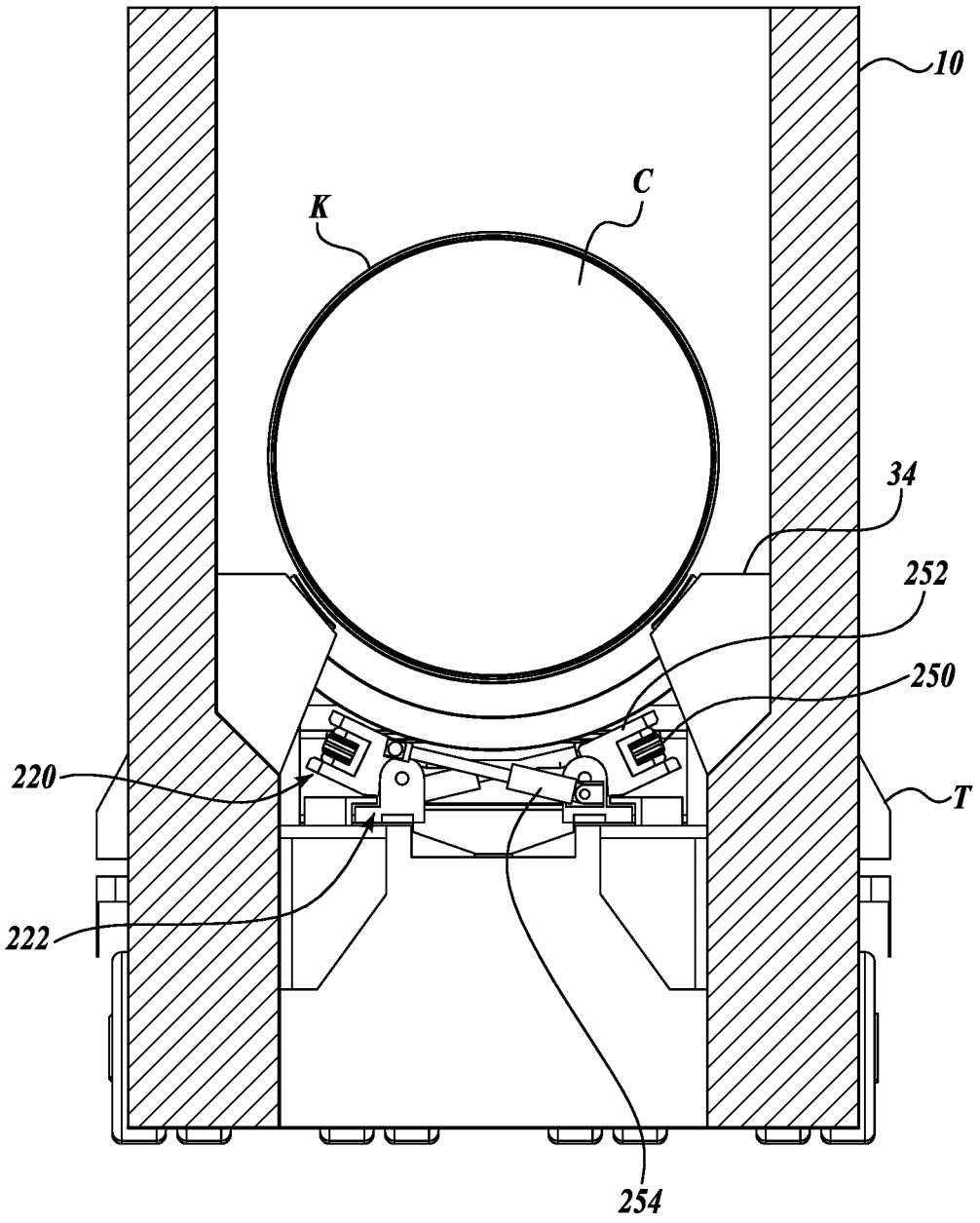

Referring now to FIG. 4A, the horizontal transfer system 220 is shown in an extended position, with the stabilization portion 222 of the horizontal transfer system 220 coupled to a transfer wagon T beneath the skid S and cask K and not in contact with the skid S or cask K, and the canister support portion 224 extended into the HSM 10. In the HSM 10, the canister support portion 224 is not in contact with the walls of the HSM 10 or the pillow blocks 34. Referring to FIG. 4B, a corresponding cross-sectional view shows the roller rails 250 oriented in the first position: oriented away from each other in a stowed position when the stabilization portion 222 of the horizontal transfer system 220 is in the process of being extended. In this view, the canister C is still in the cask K.

Figure 5D:
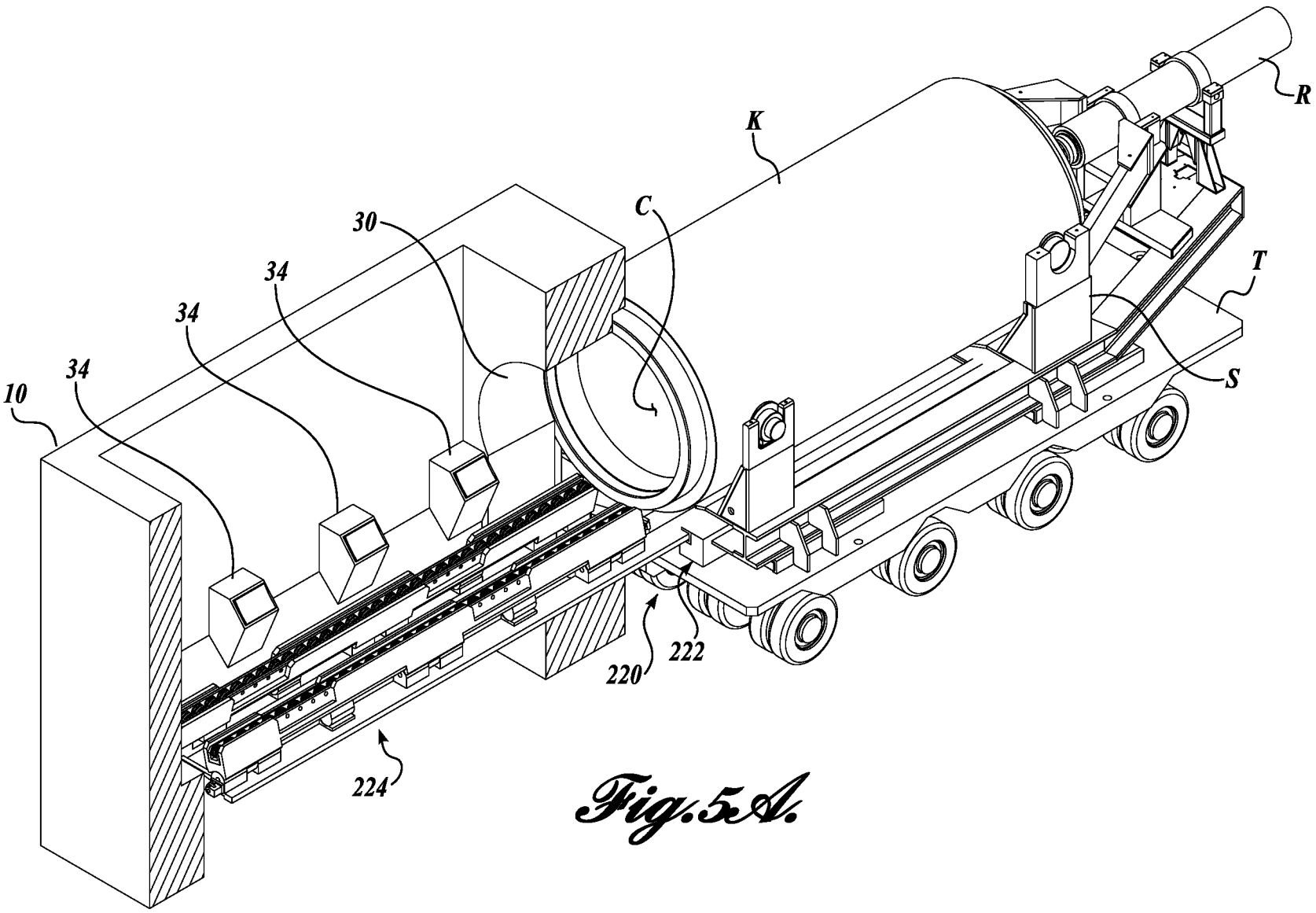
Figure 5B:
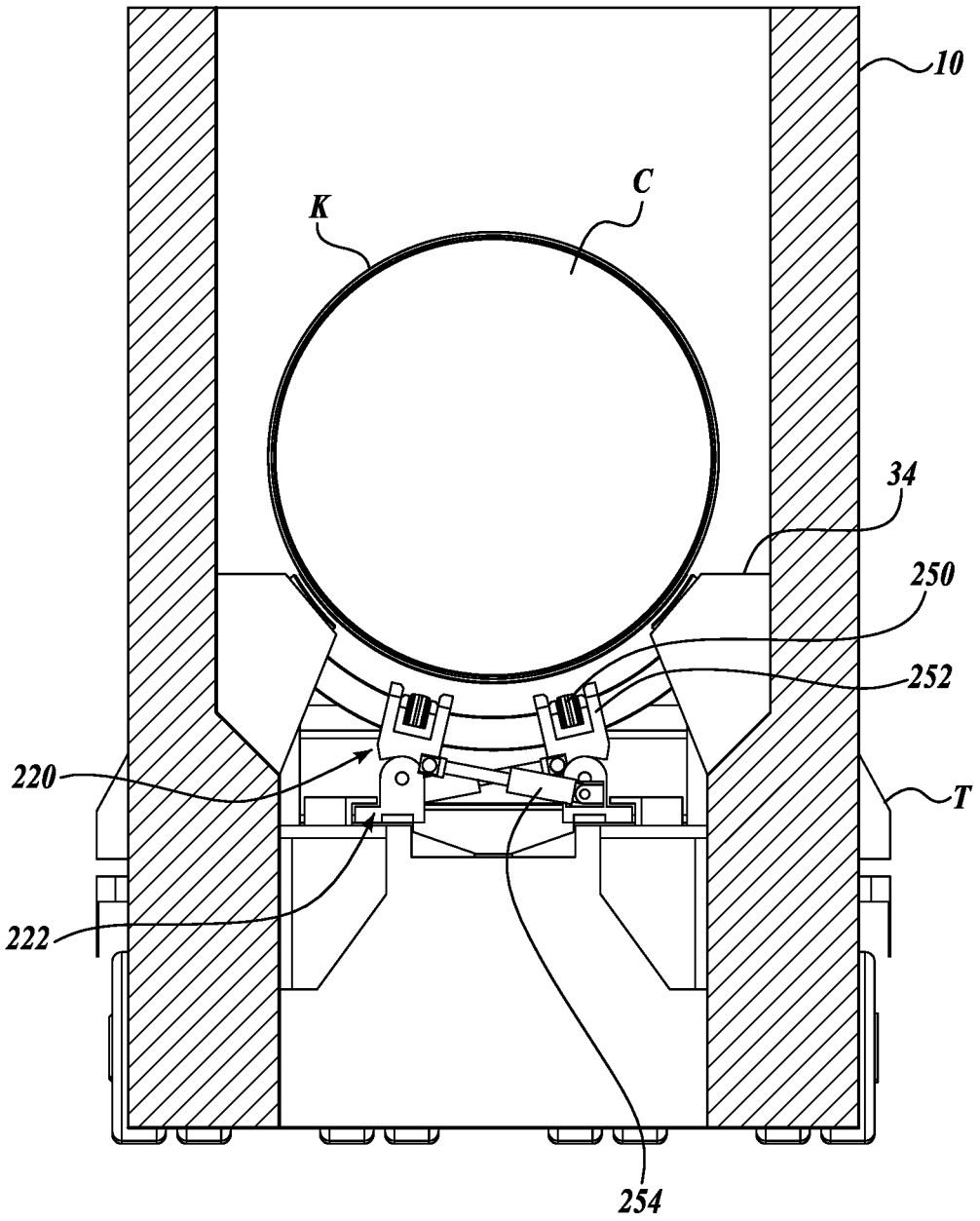

Referring now to FIGS. 5A and 5B, the roller rails 250 are moved to the second position: oriented toward each other and retracted and are ready for positioning under a canister C.

Figure 6D:
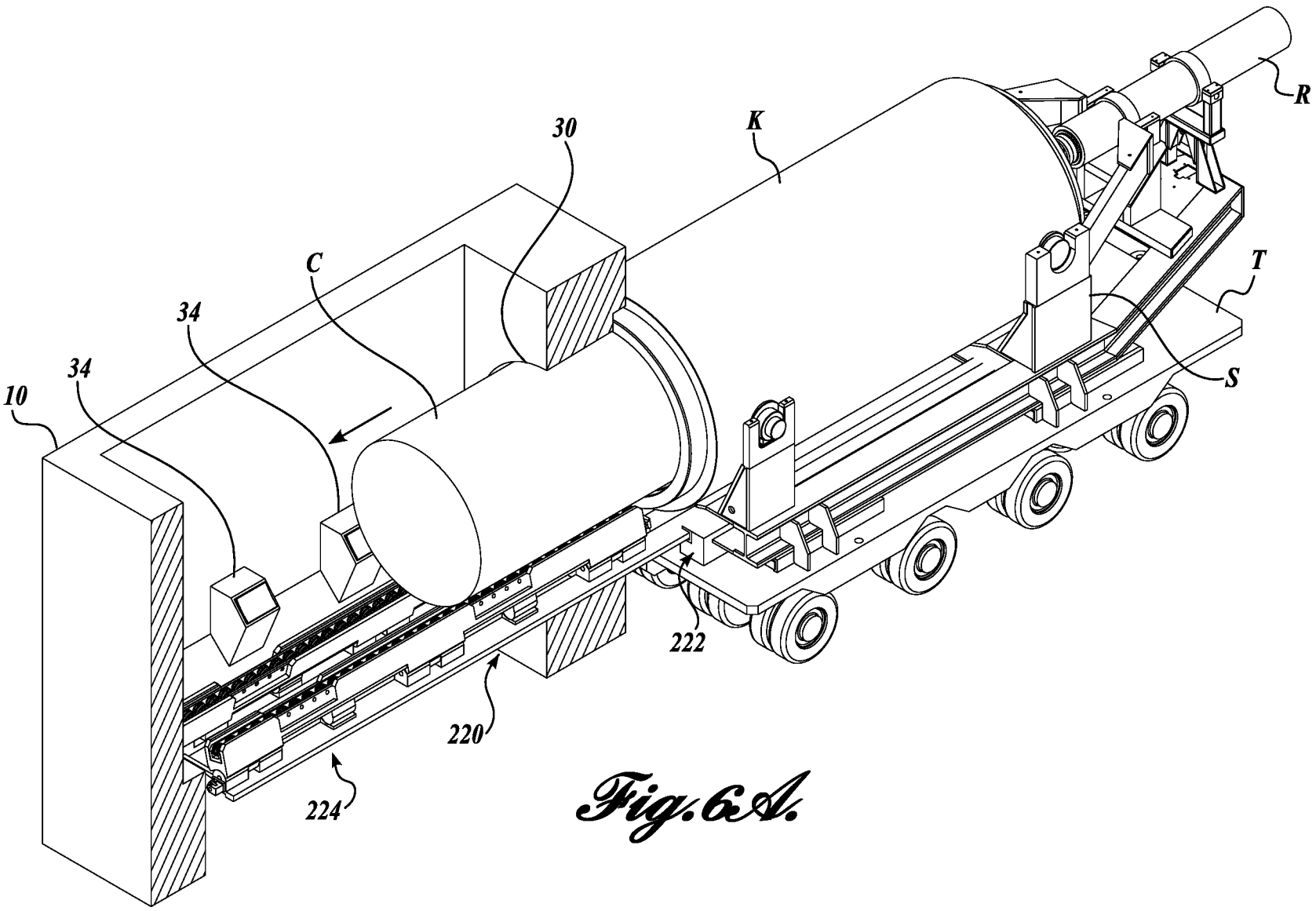
Figure 6B:
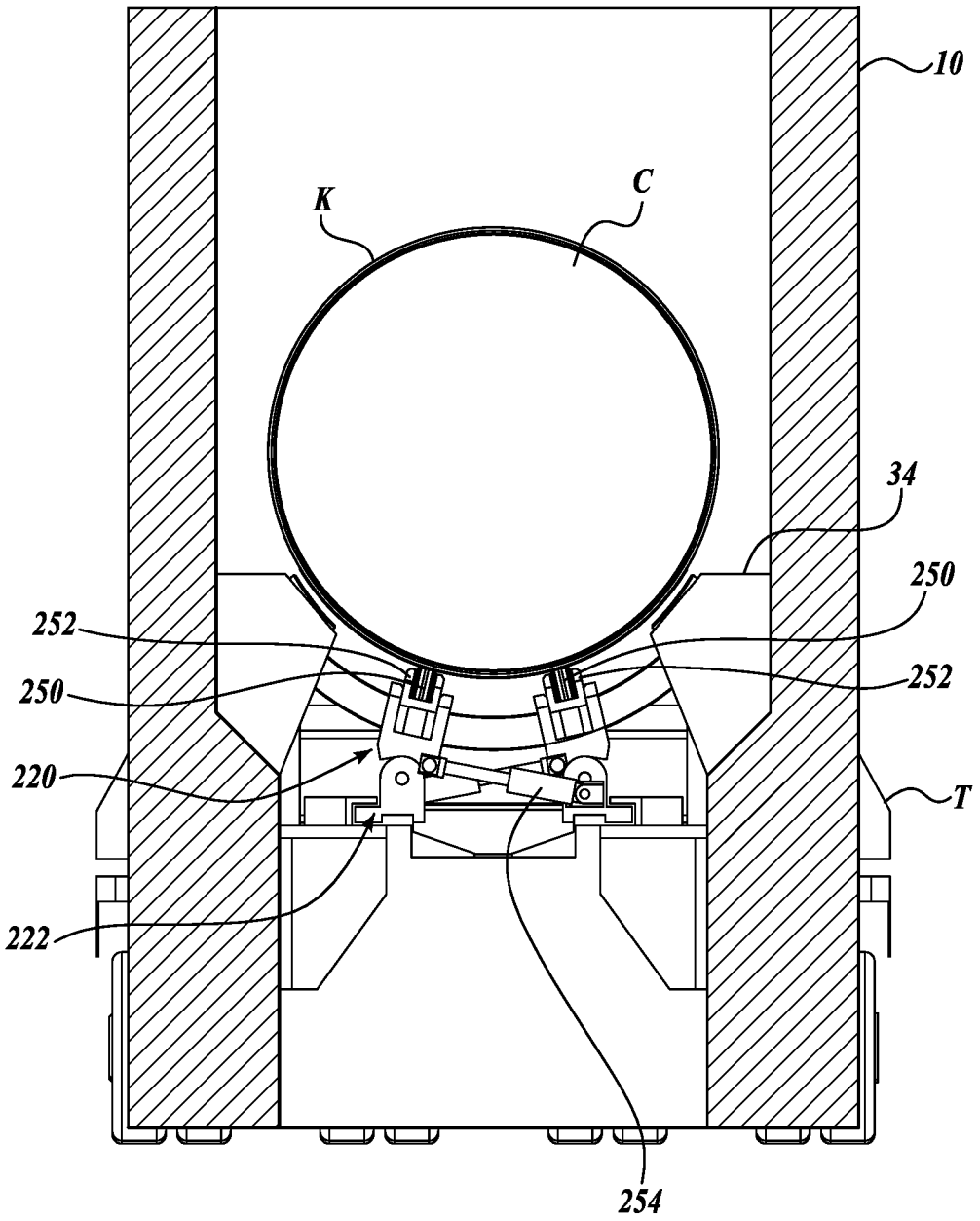

Referring now to FIGS. 6A and 6B, the roller rails 250 are moved to the third position: oriented toward each other and lifted for contact with the canister C for translational movement of the canister C from the cask K into the HSM 10. As can be seen in FIG. 6A, a linear actuator, shown as a telescoping ram device R, pushes the canister C out of the cask K and into the entry hole 30 of the HSM 10. In FIG. 6B, the canister C is shown traveling along the rollers 252 of the roller rails 250.

Figure 7B:
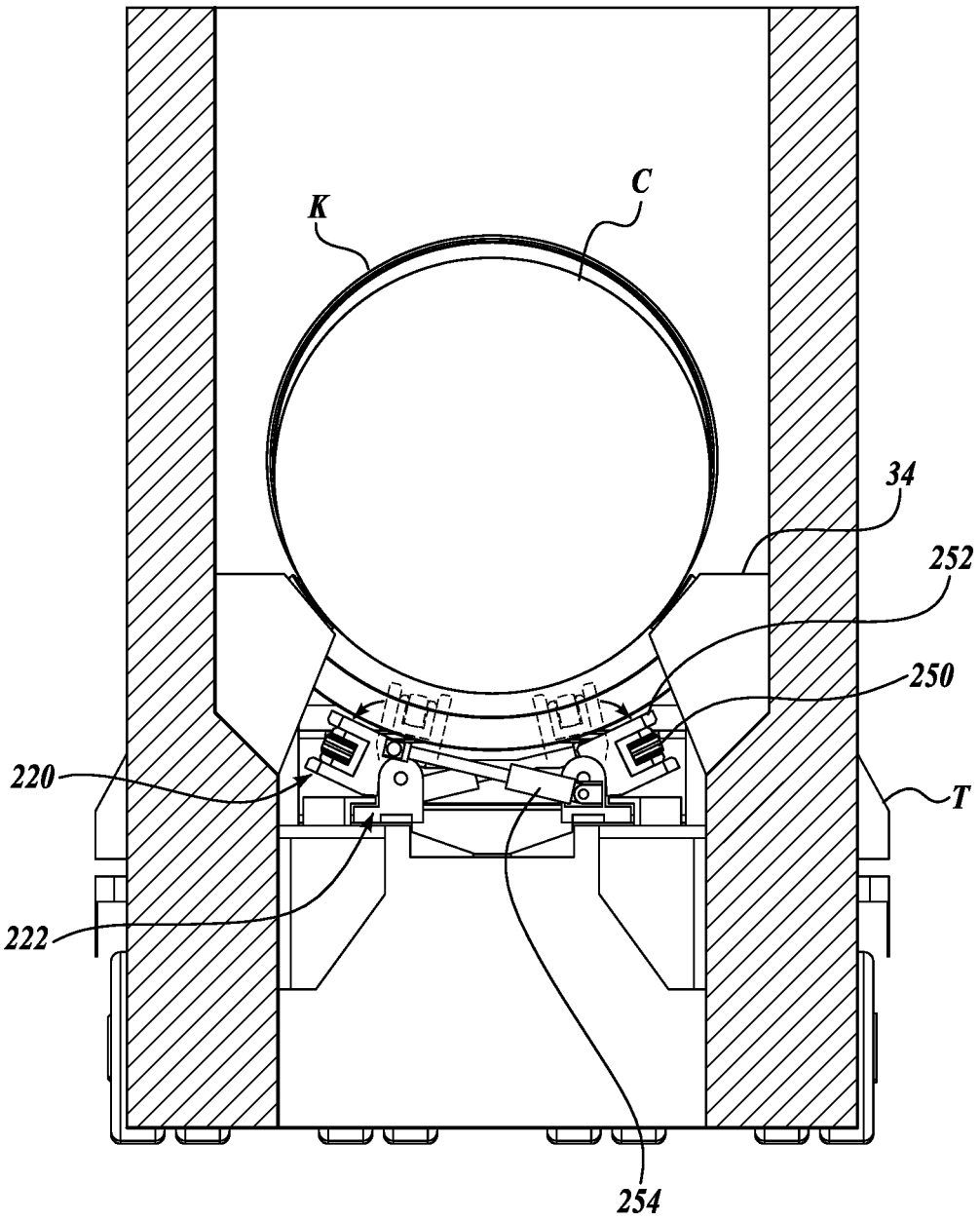
Figure 8:
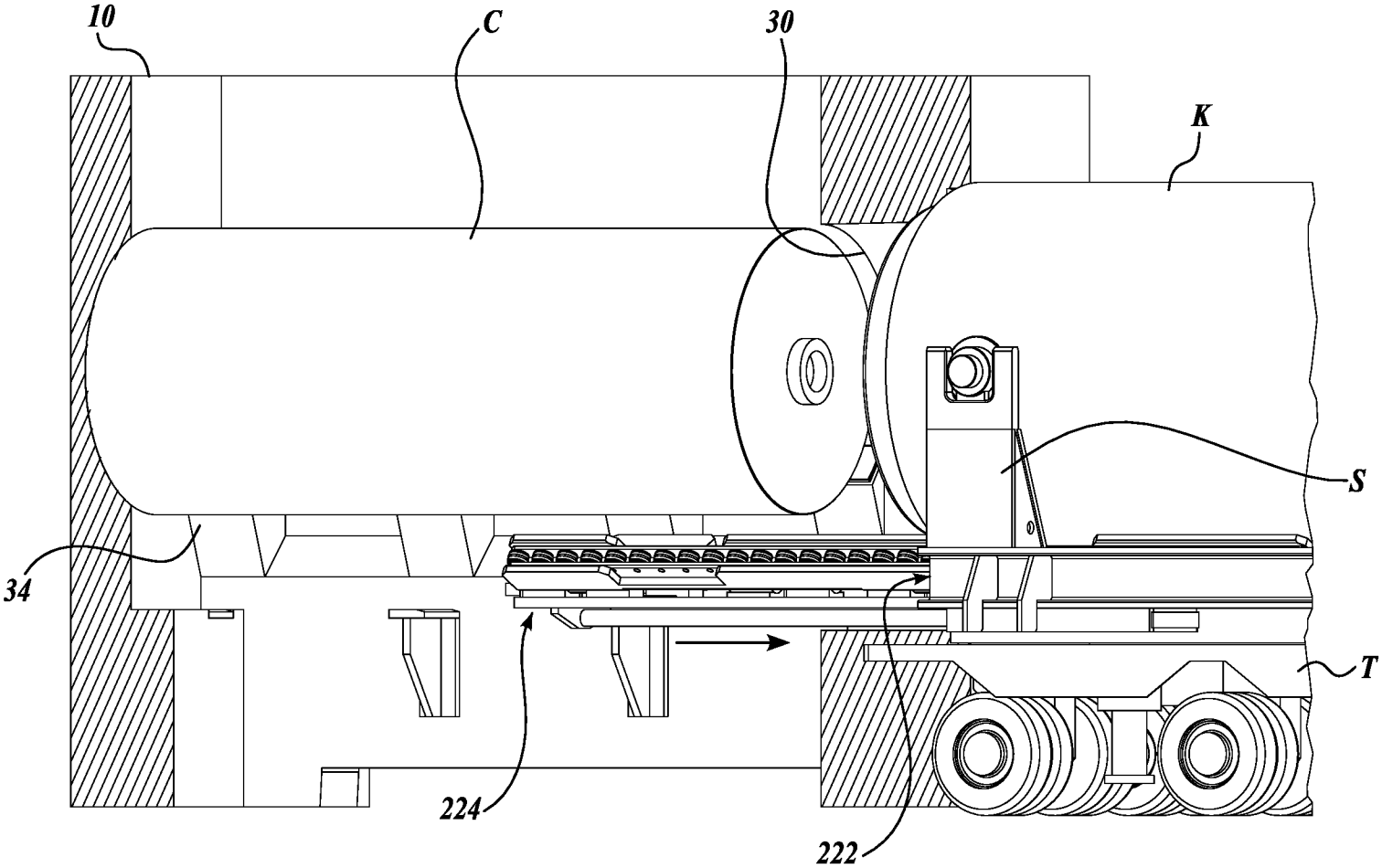

Referring now to FIGS. 7A and 7B, with the canister C fully received on the canister support portion 224 of the horizontal transfer system 220, the roller rails 250 are retracted to their second position and the canister C is lowered to rest on the pillow blocks 34 in the HSM 10. When the roller rails 250 are in the second position, the rollers 252 do not engage with the canister C. The roller rails 250 can them be returned to their first stowed position (see FIG. 7B), and the canister support portion 224 can be withdrawn from the HSM 10 (see FIG. 8) and returned to its retracted position (see FIG. 1).

Removal of the canister from the HSM can be achieved by using the reverse process steps.

Figure 9:
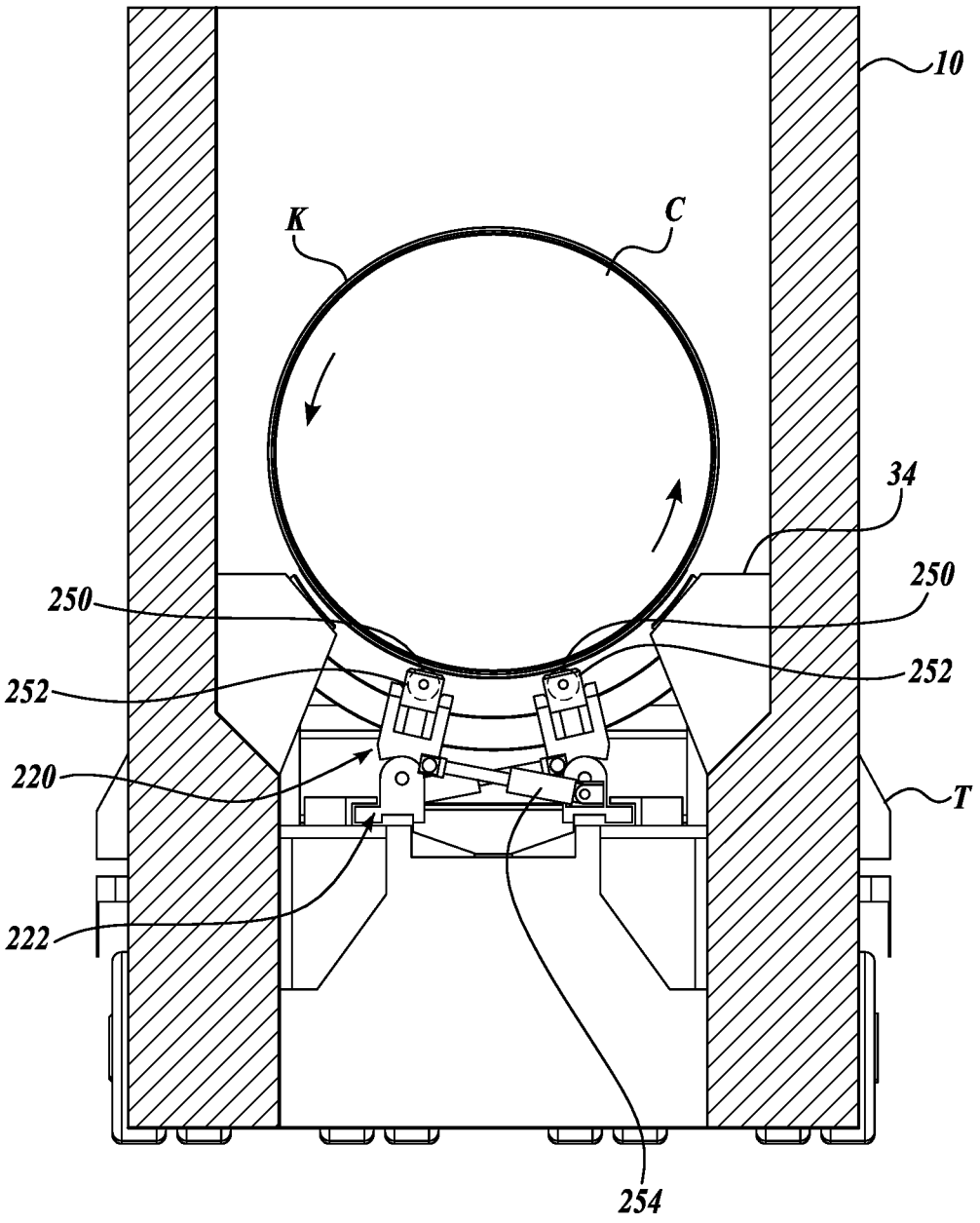
Figure 10:
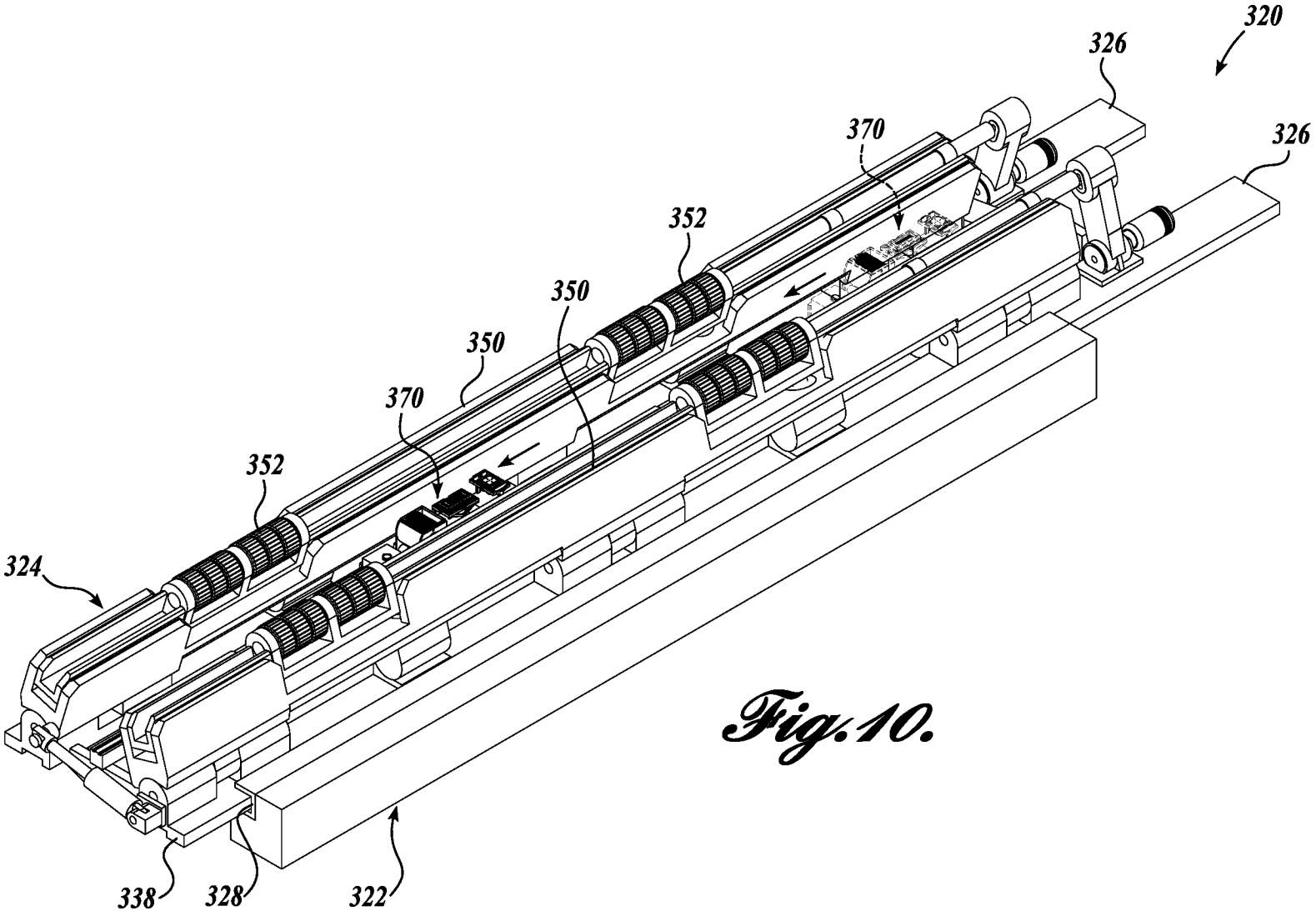
FIGS. 10-16 are various views directed to another embodiment of a movement system for a canister in accordance with the present disclosure.
Figure 12:
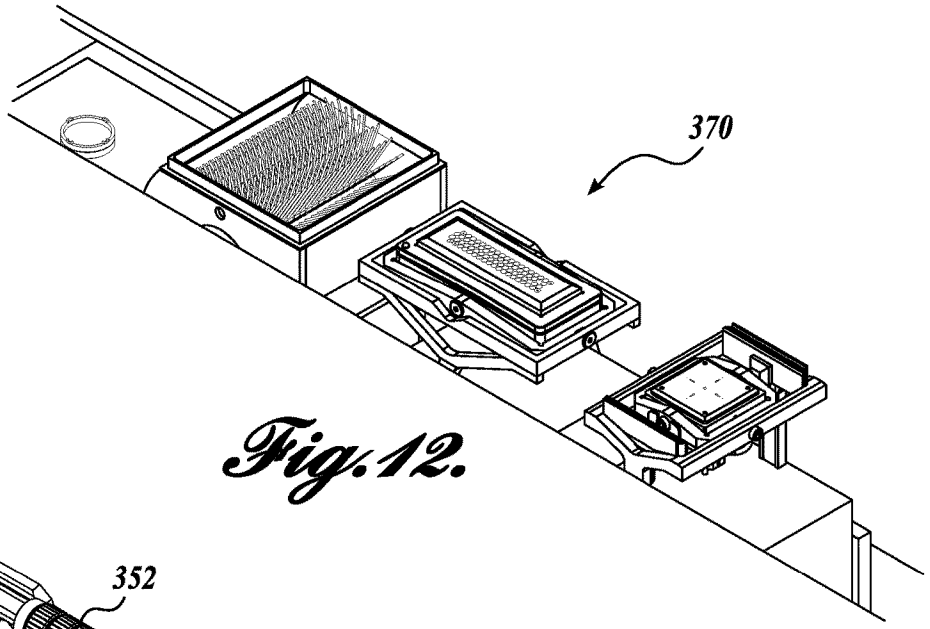
Figure 11:
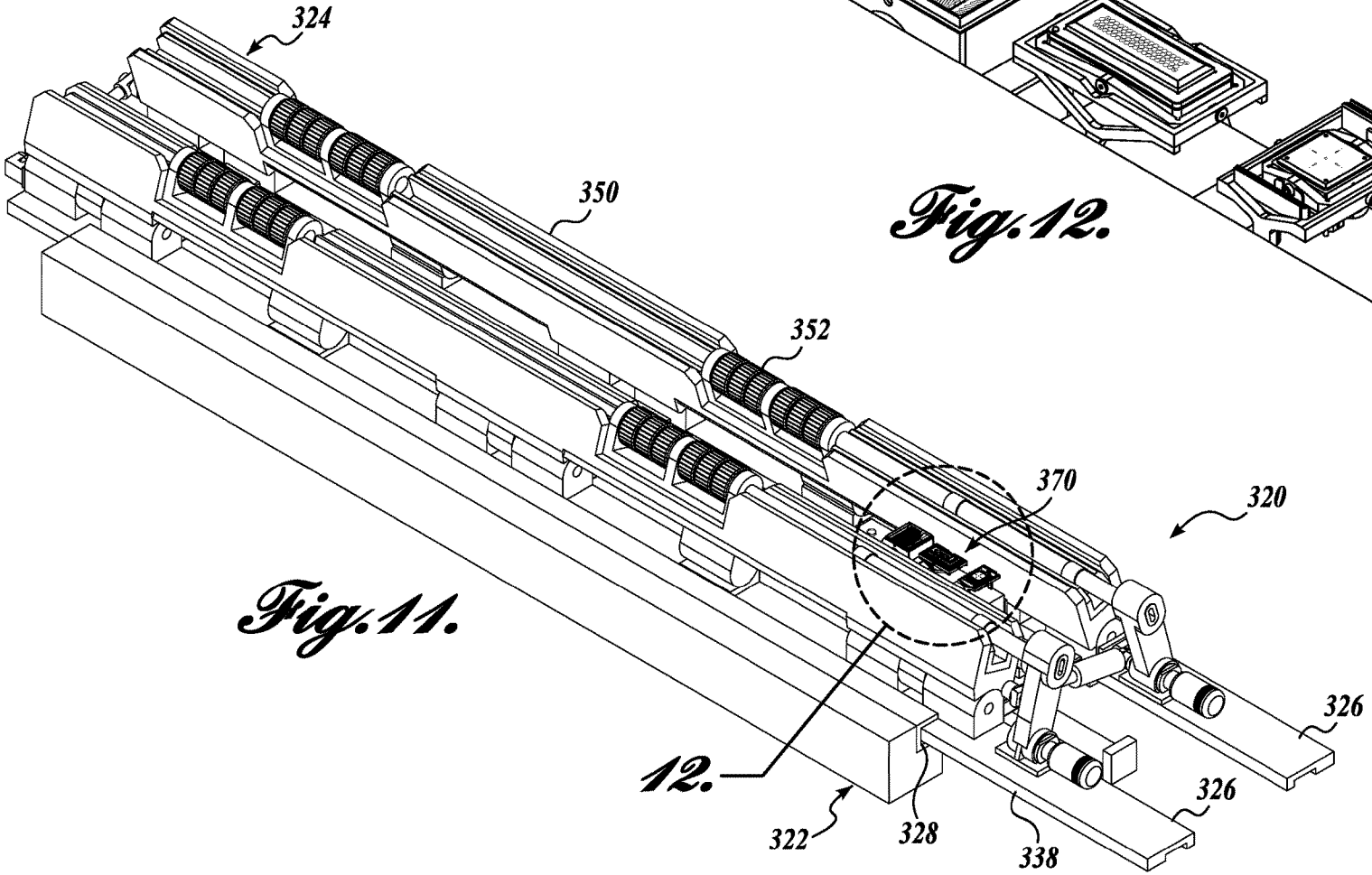
Figure 13:
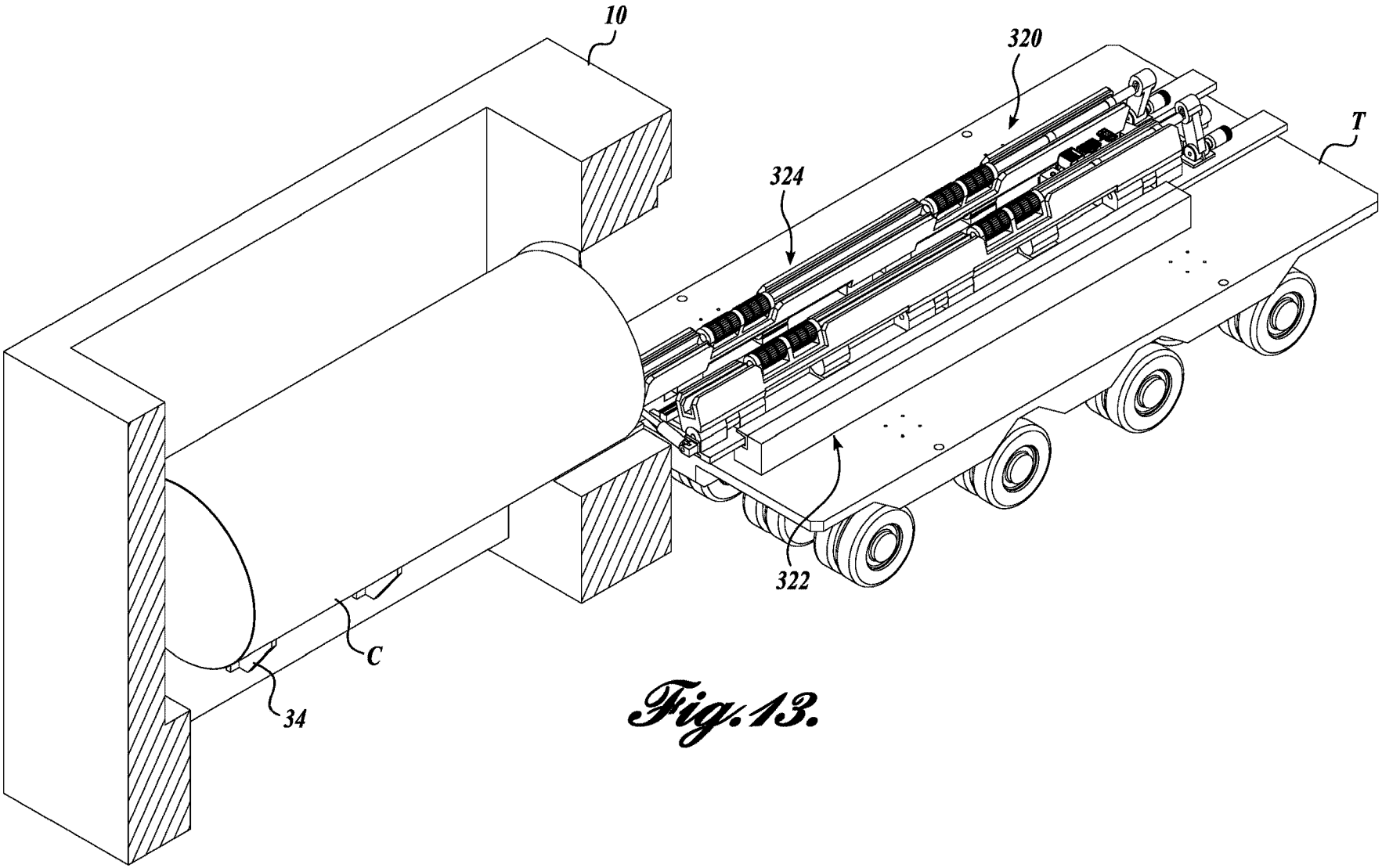
Figure 14:
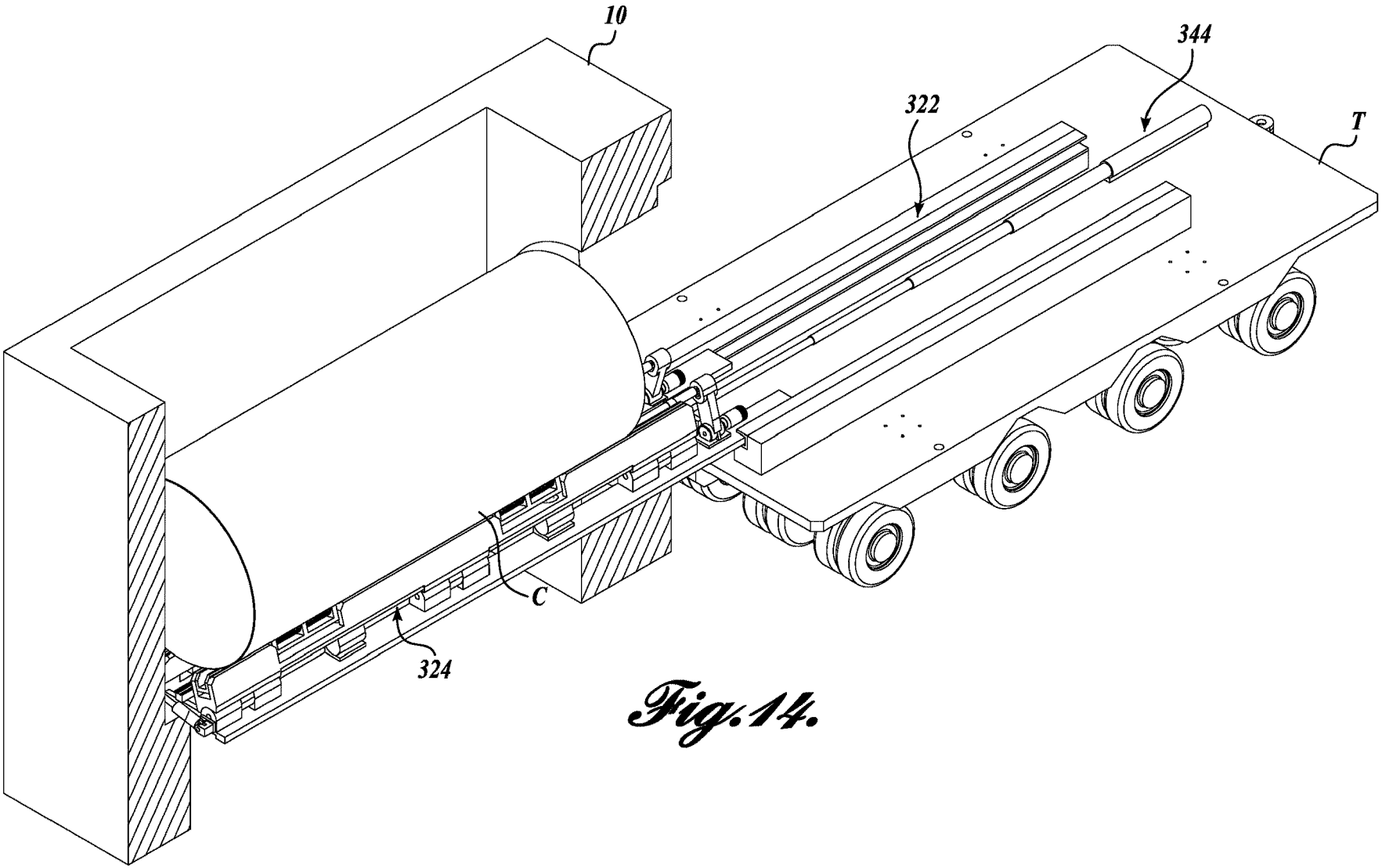

Referring to FIG. 9, rotation of a canister C can be achieved by extending the canister support portion 224 and actuating the roller rails 250 such that the rollers 252 support the canister in their fourth position: toward each other and lifted for contact with the canister C for rotational movement. The lifting may be achieved, for example, by hydraulic or electric actuators. The rotating may be achieved, for example, by hydraulic or electric motors.

In previously designed transfer systems, canisters were pushed from the cask onto rails in the HSM to transfer the canister to the HSM, resulting in scratches to the canister surface and opportunities for corrosion. Advantageous effects of the horizontal transfer system described herein include reduced friction in transferring canisters and therefore reduced scratching. Reduced scratching extends the lifespan of canisters for long term storage Further, previous rail designs were sized for unique canister dimensions. The horizontal transfer system described in the present disclosure provides for transferring canisters of variable diameters. Likewise, the methods and systems described herein can be standardized for multiple different storage systems and multiple different canister sizes, e.g., HSMs, indoor storage, centralized interim storage (CIS), and stacked CIS storage.

In addition to reduction scratching, the pillow block system in the HSM provides improved heat transfer and less air flow restriction in the HSM as compared to HSMs configured for rail transfer. The pillow blocks also offer a wider canister support angle improving the seismic stability of the HSM as compared to HSMs configured for rail transfer.

Moreover, the rotating roller mechanism of the present disclosure combined with a method for inspecting the surface of the canister inside the HSM eliminates the need to transfer the canister out of the HSM for inspection. In addition, periodic rotation of the canister within the HSM provides a method for controlling creep of the content of the canister for long term storage.

Now referring to FIGS. 10-16, a canister movement assembly 320 in accordance with another embodiment of the present disclosure is provided. The assembly 320 of FIGS. 10-16 is substantially similar to the embodiment of FIGS. 1-9, except for differences regarding movement. The assembly 220 of FIGS. 1-9 is primarily configured for transfer movement of the canister C to and from the HSM 10. However, the assembly 320 of FIGS. 10-16 is primarily configured for rotational movement of the canister C in the HSM 10.

Like the assembly 220 of FIGS. 1-9, the assembly 320 of FIGS. 10-14 includes a canister stabilization portion 322 and a canister support portion 324 capable of extending and retracting from the stabilization portion 322. The canister stabilization portion 322 is configured to slidably receive the canister support portion 324 as it moves translationally between retracted and extended positions (compare FIGS. 13 and 14). An actuator 344 (see FIG. 14) moves the canister support portion 324 relative to the canister stabilization portion 322. In the illustrated embodiment, the canister stabilization portion 322 is fixed to a trailer for movability of the assembly 320 and for additional stability.

Figure 15:
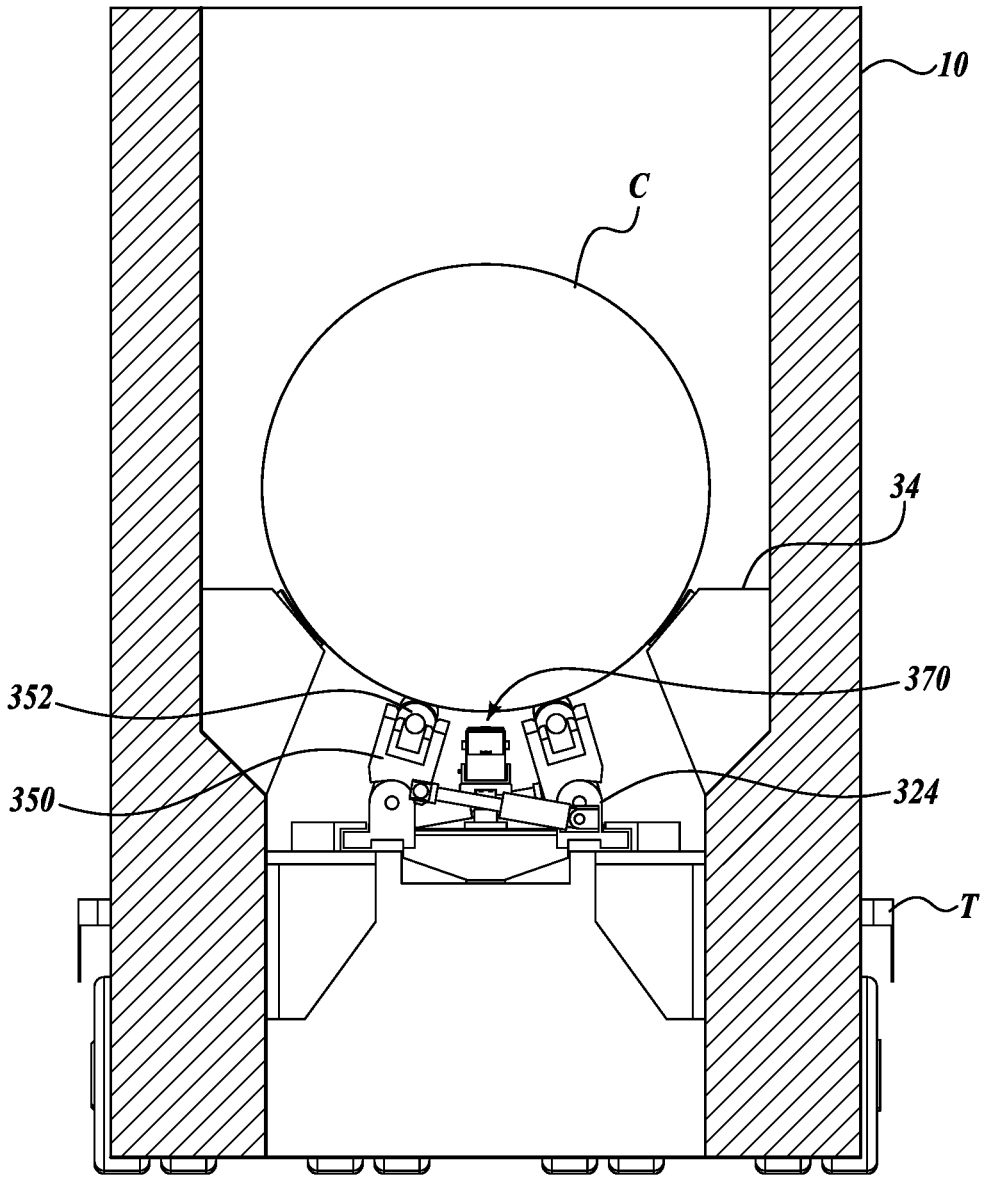
Figure 16:
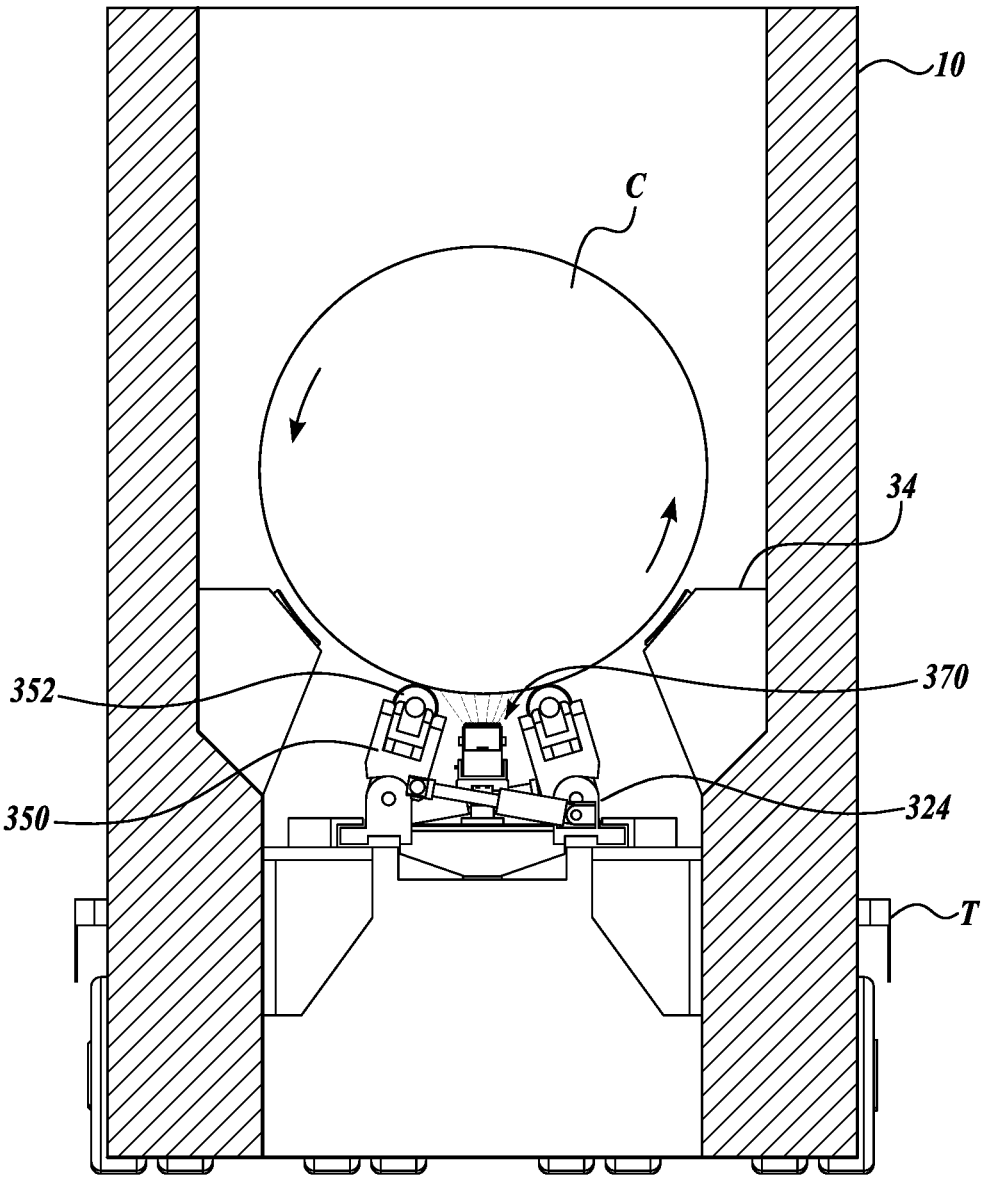

The assembly 320 further includes a retractable and extendable roller mechanism for axial rotation of a canister C (compare FIGS. 15 and 16). The rollers 352 on roller rails 350 are configured in their retracted position (see FIG. 15) when the assembly 320 is moving into its extended position in the HSM 10 (see FIG. 14). The rollers 352 on roller rails 350 are configured in their extended position (see FIG. 16) to lift the canister C from the pillow blocks 34 in the HSM 10 for rotation.

The assembly 320 further includes a canister inspection system 370 coupled to the assembly 320. The inspection system 370 is movable along the longitudinal axis of the assembly 320 as indicated by the arrow in FIG. 10. Therefore, the inspection system 370 allows for inspection of the canister along any portion of the outer cylindrical surface of the canister C as it rotates. The inspection assembly may include, but is not limited to, one or more of the following components: a brush tool; a visual inspection tool; an eddy current inspection tool; and an ultra-sonic inspection tool.

The rollers 352 are designed to rotate the canister C relative to its longitudinal axis for inspection or selective repositioning in the HSM 10. For example, during inspection, the roller rails can be used to rotate the canister 360 degrees for full inspection using the inspection system 370. The roller rails 350 can also be used to rotate the canister C to a new stationary position. For example, the roller rails 350 can be used to rotate the canister C 180 degrees to a new stationary position.

Referring now to FIGS. 17-25, another roller interface for transferring the canister C in accordance with another embodiment of the present disclosure will now be described. The roller interface of FIGS. 17-20 is similar to the roller interface of the canister support portion 224 of FIGS. 2A and 2B, except for differences regarding placement of the roller interface in the HSM 10 and extension and retraction mechanisms of the roller interface for movement of the canister C in the HSM 10. Like numerals for the embodiment of FIGS. 17-25 are used for like parts as in the embodiment of FIGS. 2A and 2B, expect in the 400 number series.

Figure 17:
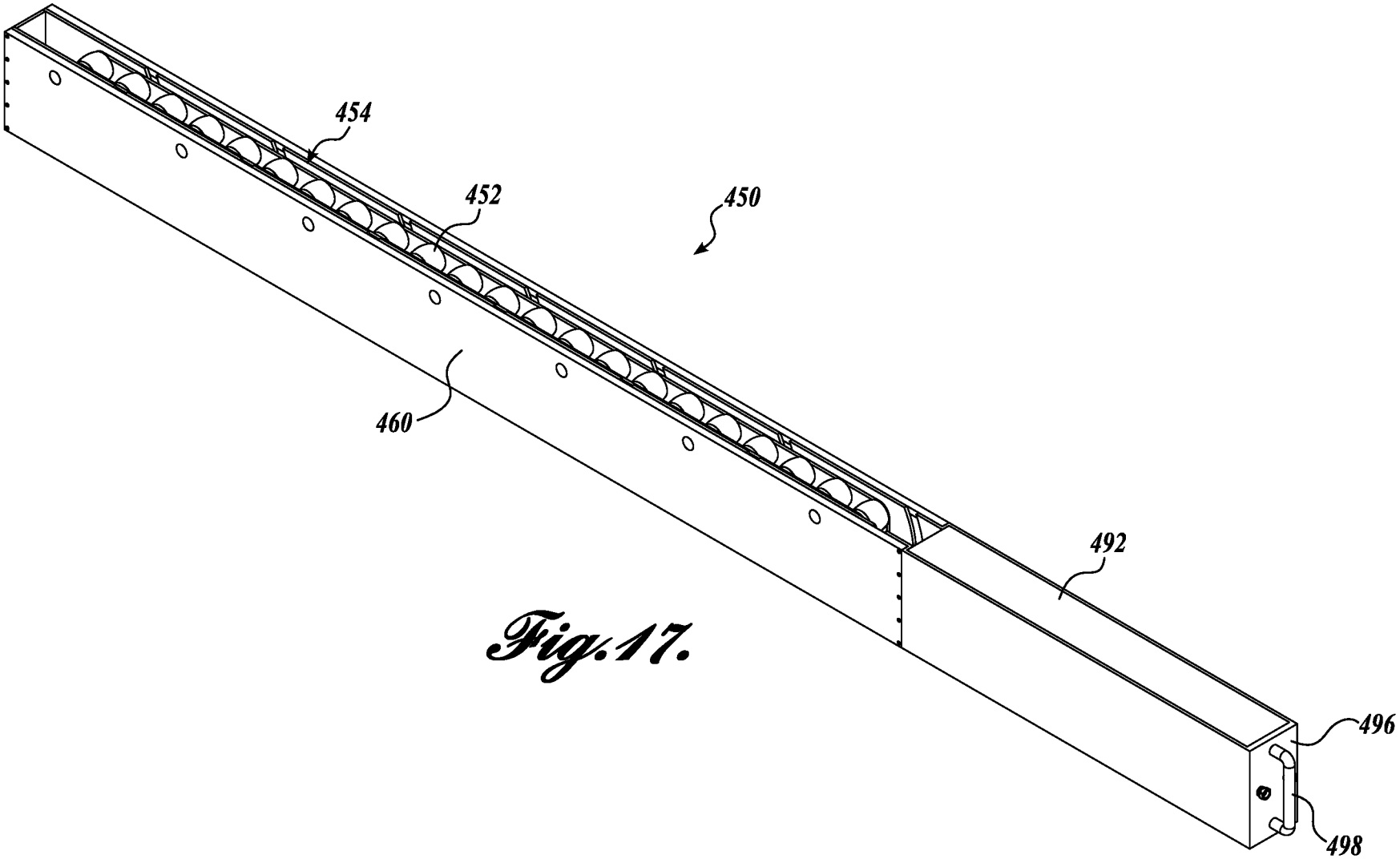
FIGS. 17-25 are various views direction to other embodiments of movement systems for a canister in accordance with the present disclosure.
Figure 18:
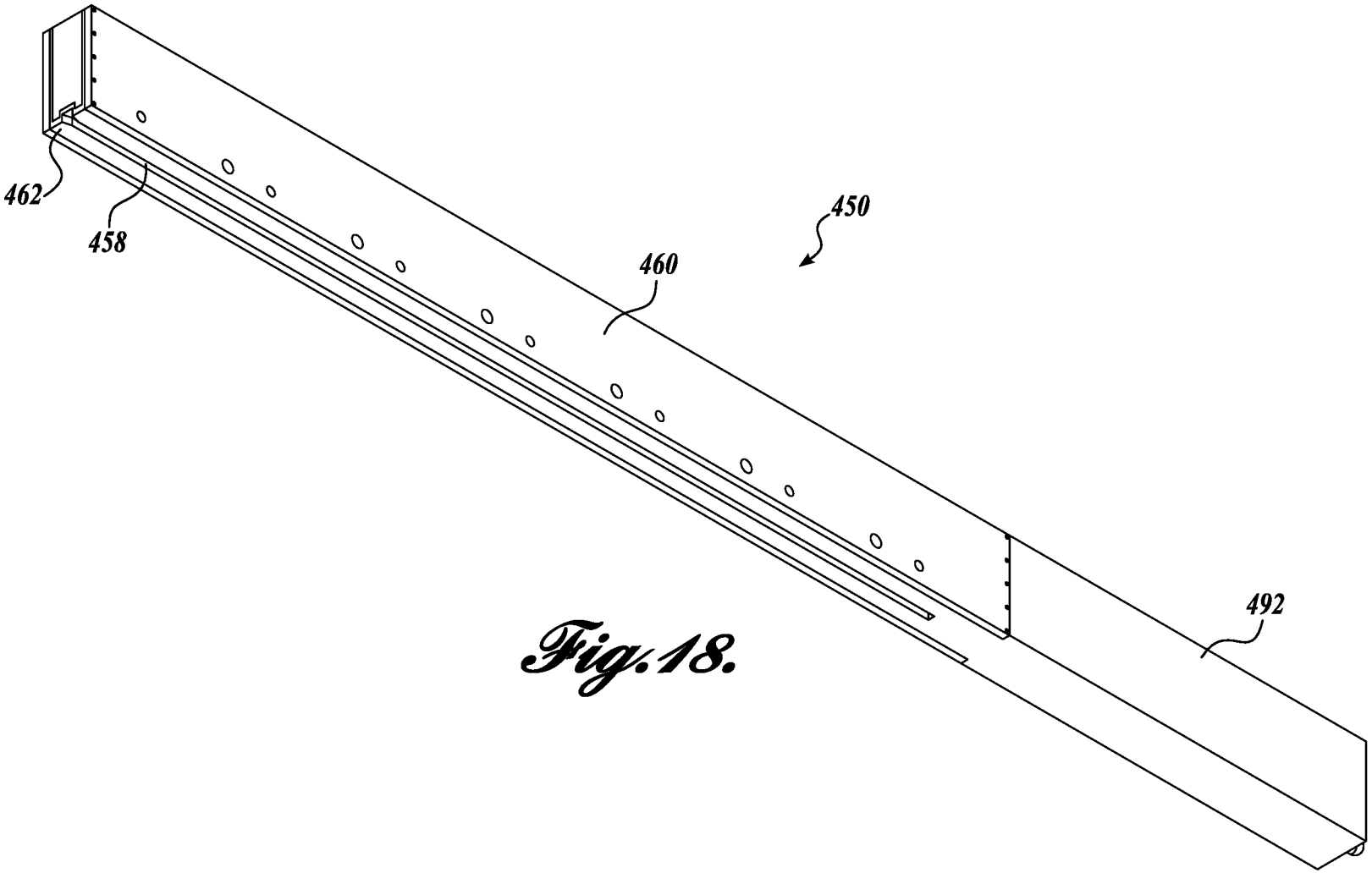

Referring to FIGS. 17 and 18, the roller interface for transferring the canister C in the illustrated embodiment of FIGS. 17-20 and 25 can be used in the cavity of the HSM 10 resting below the pillow blocks 34 (see cavity of the HSM 10 in FIG. 1). Therefore, unlike the canister support portion 224 of FIGS. 2A and 2B which extends and retracts from the skid S, the roller interface of the present embodiment may be placed in the cavity of the HSM 10 to be upwardly extended for moving a canister C and downwardly retracted when the canister C is resting on the pillow blocks 34. Such placement of the roller interface of the present embodiment in the HSM 10 may be temporary or permanent.

In the illustrated embodiment, roller beams 450 include a plurality of rollers 452 coupled in a roller array 454. Like the previously described embodiment of FIGS. 2A and 2B, the canister support portion 242 may include two roller beams 450 of the current embodiment appropriately spaced from one another to provide stable support to a canister C having a circular cross-section. However, one roller beam 450 or other groupings besides two and other spacing distances of roller beams 450 are within the scope of the present disclosure.

The base 462 of the roller beam 450 can be configured to rest on a roller actuator 254 for stabilization (as seen in the illustrated embodiment of FIGS. 2A and 2B, also seen in FIGS. 3A and 3D). In another configuration, the base 462 of the roller beam 450 is configured to sit on a rigid straight surface for stabilization and to provide the load bearing. In that regard, the base 462 of the roller beam 450 may be configured to be coupled to a horizontal or angled flat surface in the cavity of the HSM 10 as a stabilization portion (see FIG. 25). From the coupling surface, the roller beam 450 is configured to extend the roller array 454 between positions extending above the pillow blocks 34 when the canister C is in movement and retracting to be below the pillow blocks 34 when the canister C is resting on the pillow blocks 34 or bearing blocks 38.

In accordance with embodiments of the present disclosure, a sufficient number of rollers 452 having a specific diameter of axles can be selected for maximum designated load capacity of the roller beam 450. In the illustrated embodiment, the roller beam 450 includes 22 rollers 452 in the roller array 454. However, any suitable number of rollers 452 in the roller array 454 is within the scope of the present disclosure.

Figure 19:
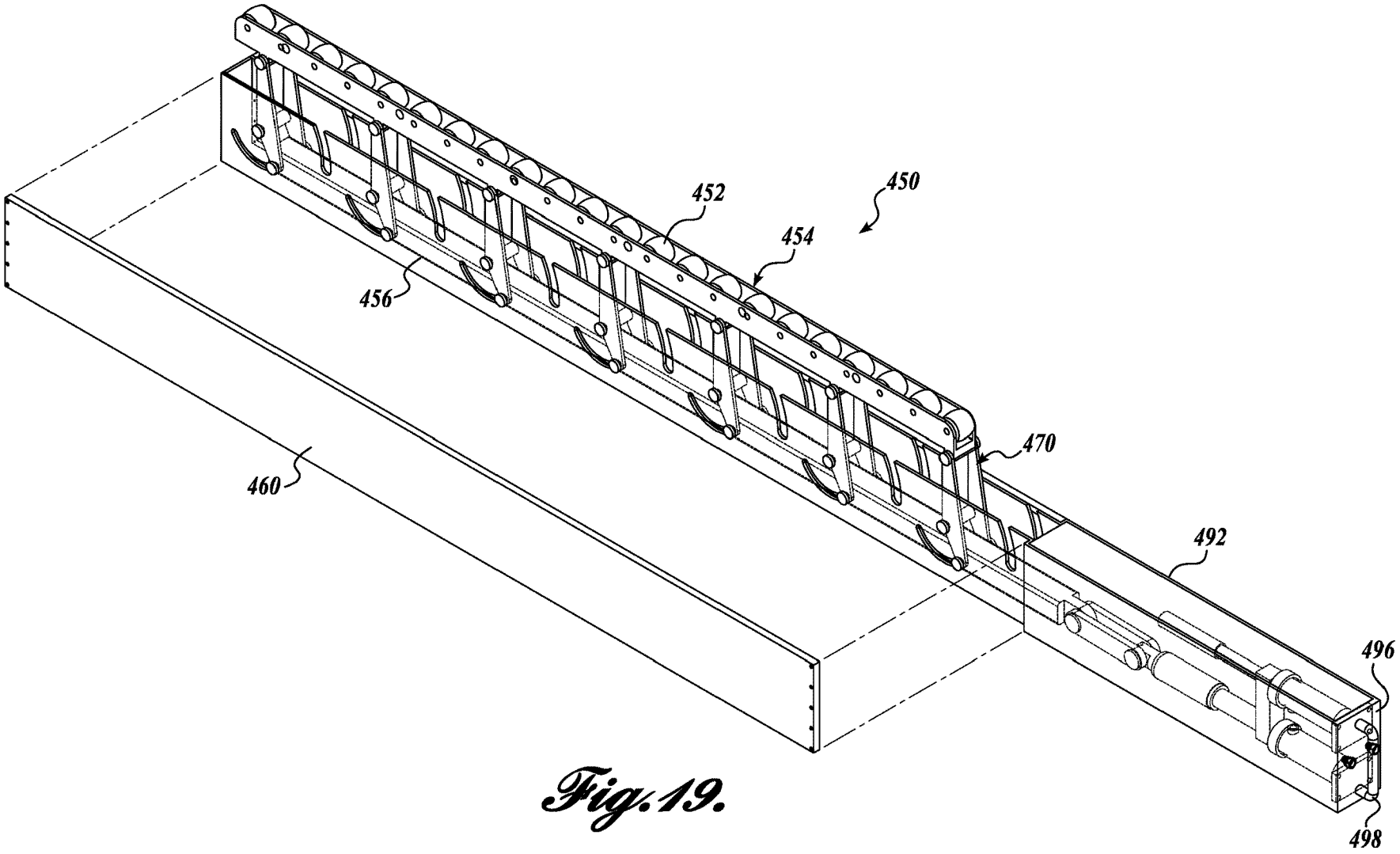

Referring to FIGS. 17-20, each roller beam 450 includes a roller tray 456, in which the roller array 454 is received. A partial exploded view in FIG. 19 shows side cover 460 removed from the roller beam 450 to show the roller tray 456. Comparing FIGS. 17 and 19, the rollers array 454 is configured to extend and retract from the roller tray 456.

In the illustrated embodiment of FIGS. 17-20, the roller beam 450 of the present embodiment uses a cam motion to extend and retract the roller array 454. The cam assembly 470 is arranged in a linear array along the length of the roller beam 450.

Figure 20:
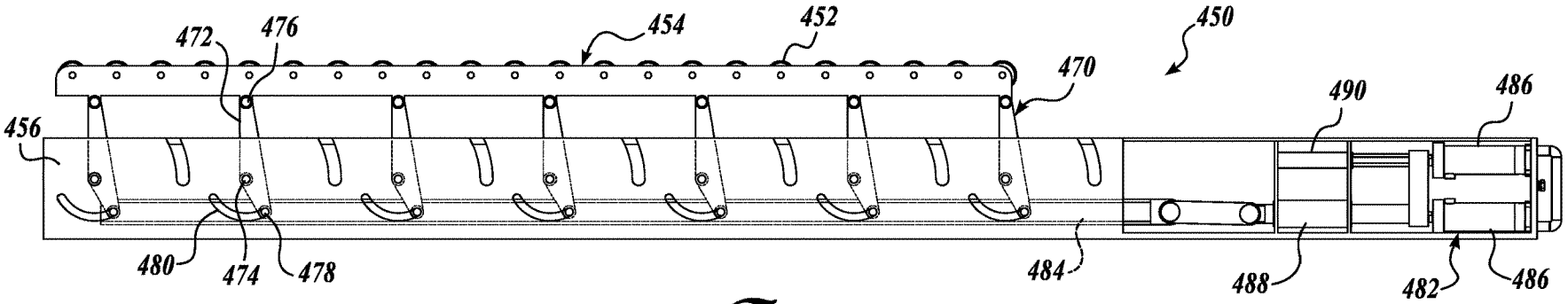

Referring to FIG. 20, the cam assembly 470 includes a plurality of cam arms 472. Each cam arm 472 is coupled to a pivot link 474 on the roller tray 456, a roller array link 476, and a swinging link 478 disposed in a channel 480 on the roller tray 456. Therefore, linear motion applied to the channel links 478 causes the roller array 454 to rotate around the pivot link 474 and extend and retract the roller array 454 between fully extended positions (see, e.g., FIG. 20) and fully retracted positions (see, e.g., FIG. 17).

Still referring to FIG. 20, the plurality of cam arms 472 are pivotably coupled by their swinging links 478 to a driving device 482. Each of the cam arms 472 are connected to the driving device 482 by a puller bar 484 attached to the swinging link 478.

In one embodiment of the present disclosure, two hydraulic cylinders 486 are arranged to work in parallel to provide driving force adequate for lifting the designated load and overcome mechanical disadvantage of uneven lifting cam arms 472. The rod 490 parallel to the plunger 488 is installed to counter the bending moment from the second cylinder 486. Such arrangement allows for minimization of the cross-section of the roller beam 450.

Reverse motion is achieved by changing the direction of hydraulic fluid inside the cylinders 486.

To prevent leakage of hydraulic fluid, the cylinders 484 are placed in the leak tight front compartment 492 and isolated from the other compartments by the sealed plunger 488. Seals are redundant to prevent the presence of fluid beyond the first compartment 492. The removable top 494 of the front compartment is also sealed. Access for the hydraulic fluid is by the fitting placed on the front panel 496 of the roller beam 450.

The front panel 496 of the roller beam 450 also includes a bar 498 for grappling and pushing/pulling the beam during installation. The long slot 458 on the bottom side of the roller beam 450 (see FIG. 18) provides direction for pushing/pulling the roller beam 450 during installation.

Figure 21C:
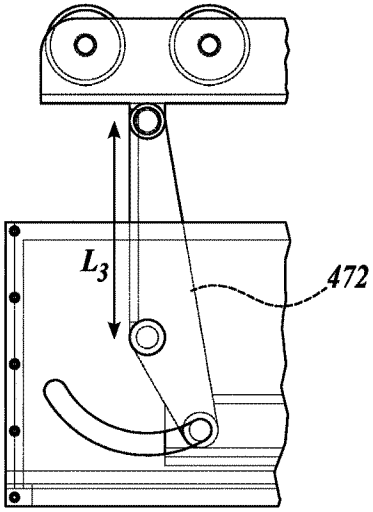
Figure 21B:
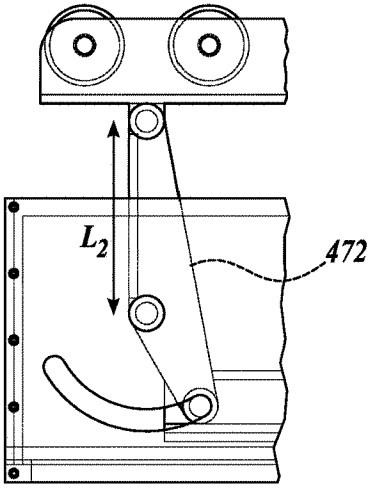
Figure 21A:
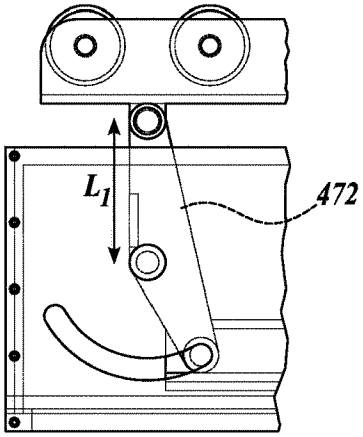

The cam arms 472 are designed for predetermined height (stroke) dependent on the size of the subject canister C to be loaded. Referring to FIGS. 21A, 21B, and 21C, a change in stroke or arm length L1, L2, and L3 may be achieved by switching the arm 472.

Referring to FIG. 19, removal of side covers 460 on the roller beam 450 provides access for exchanging the cam arms 472, while maintaining a uniform cross-section of the roller beam 450 along its length.

Figures 22, 23, 24:
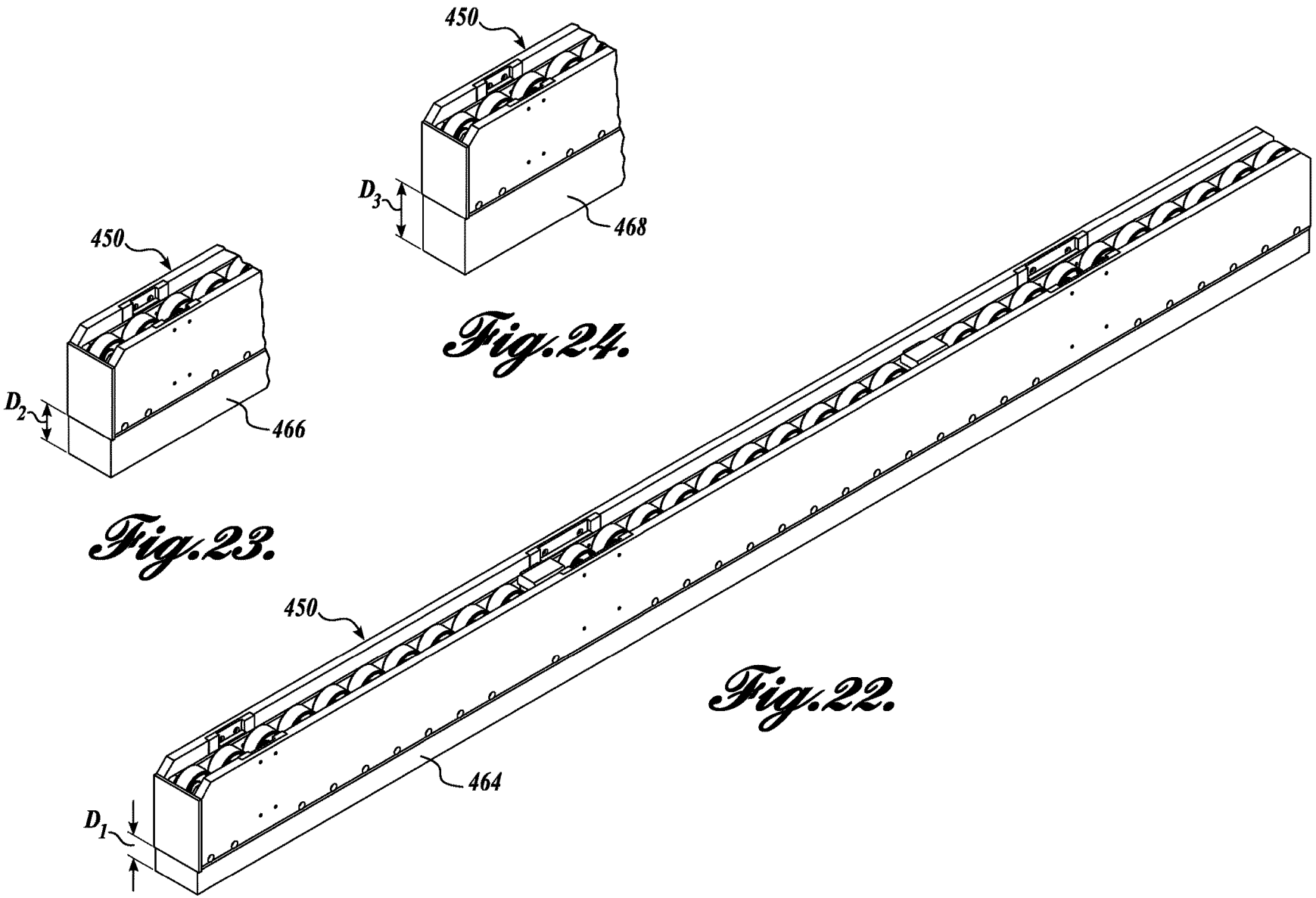
Figure 25:
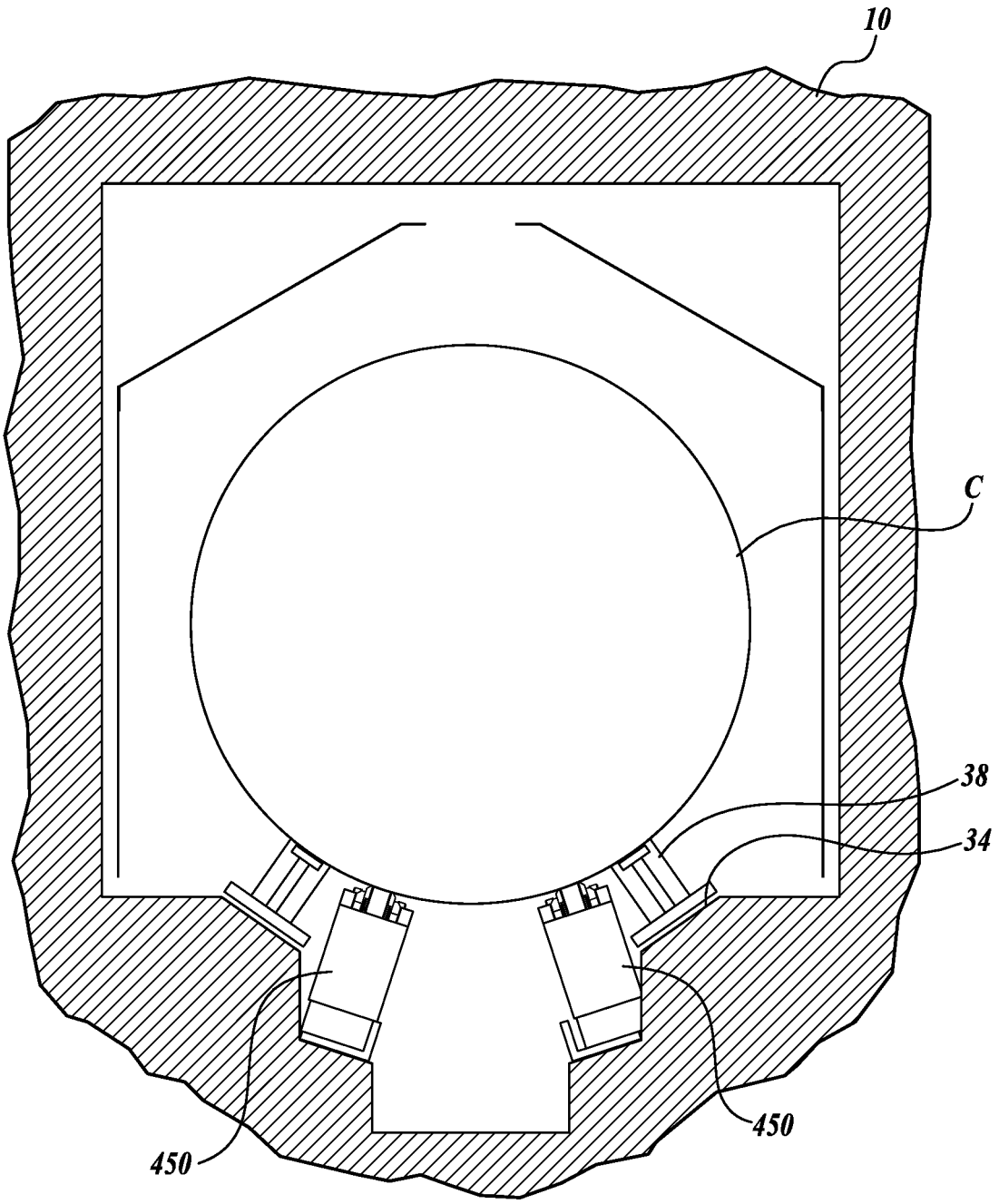

Referring to FIGS. 22-24, various spacer beams 464, 466, 468 having various heights of, for example, D1, D2, and D3 are shown for changing the roller beam 450 extension profile to accommodate canisters C of different sizes within the HSM 10.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the disclosure in which an exclusive property or privilege is claimed are defined as follows:

1. A movement system for moving a dry shielded canister, the system comprising:

a stabilization portion; and a canister support portion engaged with the stabilization portion and configured for lateral movement between an extended position of the canister support portion and a retracted position of the canister support portion relative to the stabilization portion, wherein the canister support portion extends from the stabilization portion when in the extended position of the canister support portion, the canister support portion including a roller interface for supporting and moving a canister, wherein the roller interface is configured for movement between at least extended and retracted positions of the roller interface relative to the canister support portion, wherein the roller interface is configured to be engageable with the canister when in the extended position of the roller interface and is configured to be retracted from the canister when in the retracted position of the roller interface, and wherein the roller interface includes at least two spaced roller surfaces each oriented to be tangential to the outer surface of the canister.

2. The system of claim 1, wherein the canister support portion is slidingly engaged with the stabilization portion.

3. The system of claim 1, wherein the roller interface includes a plurality of roller rails.

4. The system of claim 3, wherein the roller rails include a plurality of rollers.

5. The system of claim 3, wherein the roller rails are configurable for orientation in a stowed position.

6. The system of claim 3, wherein the roller rails are configurable for translational or rotational movement or both.

7. The system of claim 6, further comprising a support vehicle to which the stabilization portion is coupled.

8. The system of claim 6, further comprising a canister inspection system to inspect the canister as it moves on the roller rails.

9. The system of claim 1, further comprising a canister inspection system.

10. The system of claim 1, wherein the stabilization portion is a horizontal storage module (HSM).

11. The system of claim 1, wherein the canister support portion is coupled to a horizontal storage module (HSM).

12. A method of moving a dry shielded canister into or out of a horizontal storage module (HSM), the method comprising:

laterally moving a canister support portion engaged with a stabilization portion from a retracted position of the canister support portion to an extended position of the canister support portion relative to the stabilization portion to extend within a horizontal storage module, wherein the canister support portion extends from the stabilization portion when in the extended position of the canister support portion and wherein the canister support portion includes a roller interface;

moving the roller interface from a retracted position of the roller interface relative to the canister support portion to an extended position of the roller interface relative to the canister support portion to engage with the canister, wherein the roller interface includes at least two spaced roller surfaces each oriented to be tangential to an outer surface of the canister; and moving the canister along the roller interface into or out of the horizontal storage module.

13. The method of claim 12, further comprising moving the canister translationally or rotationally or both.

14. The method of claim 13, wherein the canister is moved rotationally while in the horizontal storage module.

15. The method of claim 13, further comprising retracting the roller interface after moving the canister.

16. The method of claim 12, further comprising retracting the canister support portion after retracting the roller interface.

17. The method of claim 12, further comprising inspecting the canister while moving the canister.

18. A horizontal transfer system for moving a dry shielded canister, the system comprising:

a stabilization portion; and a canister support portion engaged with the stabilization portion and configured for lateral translational movement between an extended position of the canister support portion and a retracted position of the canister support portion relative to the stabilization portion, wherein the canister support portion extends from the stabilization portion when in the extended position of the canister support portion, the canister support portion including a roller interface for supporting and moving a canister, wherein the roller interface is configured for vertical movement between at least extended and retracted positions of the roller interface relative to the canister support portion, wherein the roller interface is configured to be engageable with the canister when in the extended position of the roller interface and is configured to be retracted from the canister when in the retracted position of the roller interface.

19. A method of moving a dry shielded canister, the method comprising:

laterally moving a canister support portion engaged with a stabilization portion from a retracted position of the canister support portion to an extended position of the canister support portion relative to the stabilization portion, wherein the canister support portion extends from the stabilization portion when in the extended position of the canister support portion and wherein the canister support portion includes a roller interface;

moving the roller interface in at least a vertical direction from a retracted position of the roller interface relative to the canister support portion to an extended position of the roller interface relative to the canister support portion to engage with the canister; and moving the canister along the roller interface.

* * * * *